US011792908B2

(12) United States Patent
Tang et al.

(10) Patent No.: US 11,792,908 B2
(45) Date of Patent: Oct. 17, 2023

(54) TIME-DIVISION MULTIPLEXING CONTROL DEVICE AND SYSTEM

(71) Applicant: NuRay Technology Co., Ltd., Jiangsu (CN)

(72) Inventors: Huaping Tang, Jiangsu (CN); Jinsong Pan, Jiangsu (CN); Yangwei Zhan, Jiangsu (CN); Zhanfeng Qin, Jiangsu (CN); Qinghui Zhang, Jiangsu (CN); Xiangyu Yin, Jiangsu (CN)

(73) Assignee: NuRay Technology Co., Ltd., Jiangsu (CN)

( * ) Notice: Subject to any disclaimer, the term of this patent is extended or adjusted under 35 U.S.C. 154(b) by 0 days.

(21) Appl. No.: 17/755,520

(22) PCT Filed: Apr. 13, 2020

(86) PCT No.: PCT/CN2020/084451
§ 371 (c)(1),
(2) Date: Apr. 29, 2022

(87) PCT Pub. No.: WO2021/082356
PCT Pub. Date: May 6, 2021

(65) Prior Publication Data

US 2022/0384135 A1 Dec. 1, 2022

(30) Foreign Application Priority Data

Oct. 30, 2019 (CN) ..... 201911051016.4

(51) Int. Cl.
*H05G 1/70* (2006.01)
*H05G 1/56* (2006.01)
(Continued)

(52) U.S. Cl.
CPC ..... *H05G 1/70* (2013.01); *H05G 1/265* (2013.01); *H05G 1/56* (2013.01); *H01J 35/025* (2013.01)

(58) Field of Classification Search
CPC ..... H05G 1/70; H05G 1/56
See application file for complete search history.

(56) References Cited

U.S. PATENT DOCUMENTS 4,734,924 A 3/1988 Yahata et al.
5,339,348 A 8/1994 Wirth et al.
(Continued)

FOREIGN PATENT DOCUMENTS

CN 104068881 A 10/2014
CN 104220000 A 12/2014
(Continued)

OTHER PUBLICATIONS

International Search Report and Written Opinion issued for International Patent Application No. PCT/CN2020/084451, dated Oct. 30, 2019 in 10 pages.

*Primary Examiner* — Chih-Cheng Kao
(74) *Attorney, Agent, or Firm* — Knobbe Martens Olson & Bear LLP

(57) ABSTRACT

A time-division multiplexing control device applied to a distributed X-ray source includes: a first switch module with a number of first switches that receive a high-voltage signal and a first control signal, selectively turning on one of the plurality of first switches according to the first control signal and sending the high-voltage signal through the first switch turned on; and a cathode control module including a plurality of cathode control stages in one-to-one correspondence with the plurality of first switches, used for receiving the high-voltage signal from the first switch module and sending working state data through a cathode control stage corresponding to the first switch turned on in the plurality of
(Continued)

cathode control stages, where each cathode control stage includes a cathode control unit and a cathode.

20 Claims, 10 Drawing Sheets

(51) Int. Cl.
*H05G 1/26* (2006.01)
*H01J 35/02* (2006.01)

(56) References Cited

U.S. PATENT DOCUMENTS

2010/0226479 A1* 9/2010 Beyerlein ..... H01J 35/065
378/134
2014/0185739 A1* 7/2014 Tang ..... H05G 1/70
378/4
2020/0367350 A1* 11/2020 Fritz ..... H05G 1/265

FOREIGN PATENT DOCUMENTS

CN 104465279 A 3/2015
CN 104470171 A 3/2015
CN 104470172 A 3/2015
CN 104470176 A 3/2015

* cited by examiner

TIME-DIVISION MULTIPLEXING CONTROL DEVICE AND SYSTEM

CROSS-REFERENCE TO RELATED APPLICATION

This application is the U.S. national phase under 35 U.S.C. 371 of PCT application No. PCT/CN2020/084451, filed on Apr. 13, 2020, which claims priority to Chinese Application No. 201911051016.4, filed Oct. 30, 2019, incorporated herein by reference in their entireties.

TECHNICAL FIELD

The present disclosure relates to fields of industrial non-destructive testing, safety inspection, medical diagnosis and treatment, etc., and in particular, to a time-division multiplexing control device and system, applied to a distributed X-ray source.

BACKGROUND

X-rays have a wide range of applications in fields of industrial non-destructive testing, safety inspection, medical diagnosis and treatment, etc. A device that generates X-rays is called an X-ray source, and the X-ray source is generally composed of an X-ray tube, a high-voltage power supply control system, and auxiliary devices such as cooling and shielding devices. The existing high-voltage power supply control systems are generally single-output power supplies for one cathode, and adjustment for an output voltage usually takes a long time, generally on an order of milliseconds or even seconds.

A multi-focus X-ray source (or known as a distributed X-ray source) has hundreds of cathode-anode assemblies integrated within a tube structure at high density. The multi-focus X-ray source may radiate X-rays from a plurality of different locations to quickly perform transmission imaging to the target object with different viewing angles, and each cathode-anode assembly may keep working independently. The multi-focus X-ray source includes a plurality of channels, each of which corresponds to an emission cathode, and each emission cathode is driven by the control system to emit electrons. At the same time, an output current of each channel may be quickly and automatically adjusted through real-time negative feedback, and the new multi-focus X-ray source may be turned on and off instantaneously at the microsecond (μs) level.

The existing X-ray source control methods do not clearly specify how to drive a control unit of the emission cathode and how to collect working state data of a cathode control stage. Or, in the existing methods, each cathode control stage corresponds to one driver circuit and one collection circuit, as such, a plurality of driver circuits and collection circuits are required when driving a plurality of cathode control stages and performing data collection on the cathode control stages.

The more driver circuits (also known as "digital-to-analog (DA) driver modules or circuits") and collection circuits (also known as "analog-to-digital (AD) collection modules or circuits"), the more the resources are consumed, the higher the cost is, and the larger the designed hardware device is. Moreover, it is inconvenient to extend and expand, and it needs to be changed when the number of cathode control stages is changed.

Therefore, there is a need for a power control system that may control a plurality of channels and adjust an output current of each channel to control and drive the cathodes of the multi-focus X-ray source, so as to meet the requirements of instantaneous start-up and shutdown of the new multi-focus X-ray source and intelligent control.

SUMMARY

According to one aspect of the present disclosure, a time-division multiplexing control device applied to a distributed X-ray source is provided, including:

a first switch module including a plurality of first switches, used for receiving a high-voltage signal and a first control signal, selectively turning on one of the plurality of first switches according to the first control signal and sending the high-voltage signal through the first switch turned on; and a cathode control module including a plurality of cathode control stages in one-to-one correspondence with the plurality of first switches, and used for receiving the high-voltage signal from the first switch module and sending working state data through a cathode control stage corresponding to the first switch turned on in the plurality of cathode control stages, where each cathode control stage includes a cathode control unit and a cathode.

In an embodiment, in the cathode control stage corresponding to the first switch turned on, a cathode control unit is configured to receive the high-voltage signal, send a drive control signal to the cathode, perform automatic feedback adjustment according to the feedback signal, and send working state data; and the cathode is configured to send the feedback signal to the cathode control unit according to the drive control signal.

In an embodiment, the time-division multiplexing control device further includes:

a collection feedback module configured to receive a feedback signal from the cathode control module and send the feedback signal; and a feedback switch module including a plurality of feedback switches, and used for receiving a feedback control signal, receiving the feedback signal from the collection feedback module, selectively turning on one of the plurality of feedback switches according to the feedback control signal, and sending the feedback signal to the cathode control module through the feedback switch turned on, wherein in the cathode control stage corresponding to the first switch turned on, the cathode control unit is configured to receive the high-voltage signal and the feedback signal, send the drive control signal to the cathode, perform automatic feedback adjustment according to the feedback signal, and send working state data; the cathode is configured to send the feedback signal to the collection feedback module according to the drive control signal.

In an embodiment, each of the plurality of first switches is formed by a plurality of metal oxide semiconductor MOS transistors in series.

In an embodiment, the time-division multiplexing control device further includes:

a second switch module including a plurality of second switches in one-to-one correspondence with the plurality of cathode control stages, used for receiving a drive signal and a second control signal, selectively turning on one of the plurality of second switches according to the second control signal, and sending the drive signal through the second switch turned on, wherein the cathode control module is further configured to receive the drive signal from the second switch module, and send the working state data through one of plurality of cathode control stages corresponding to the first switch turned on and the second switch turned on, and wherein the first control signal and the second control signal are provided so that the first switch turned on and the second switch turned on are coupled with the same cathode control stage.

In an embodiment, the time-division multiplexing control device further includes:

a third switch module including a plurality of third switches in one-to-one correspondence with the plurality of cathode control stages, used for receiving a third control signal, receiving the working state data from the cathode control module, selectively turning on one of the plurality of third switches according to the third control signal, and sending the working state data through the third switch turned on, wherein the first control signal, the second control signal, and the third control signal are provided so that the first switch turned on, the second switch turned on, and the third switch turned on are coupled with the same cathode control stage, or the first control signal, the second control signal, the third control signal and a feedback control signal are provided so that the first switch turned on, the second switch turned on, the third switch turned on and a feedback switch turned on are coupled with the same cathode control stage.

In an embodiment, the time-division multiplexing control device further includes:

a control module for providing the first control signal to the first switch module, the second control signal to the second switch module, and the third control signal to the third switch module under control of a second master control signal, or providing the first control signal to the first switch module, the second control signal to the second switch module, the third control signal to the third switch module and the feedback control signal to a feedback switch module under control of a second master control signal.

In an embodiment, the time-division multiplexing control device further includes:

a collection module for receiving the working state data from the third switch module and sending the working state data;

a master control module for providing a first master control signal, providing the second master control signal to the control module, and receiving the working state data from the collection module:

a driver module for receiving the first master control signal from the master control module, and providing the drive signal to the second switch module according to the first master control signal; and a high-voltage source for providing the high-voltage signal.

In an embodiment, the time-division multiplexing control device further includes:

an isolator for isolating the master control module from a central processing unit module.

In an embodiment, the time-division multiplexing control device operates in a high-voltage operation environment.

In an embodiment, the first switch, the second switch, and the third switch are implemented by using analog switch elements, digital switch elements, relays, or photocouplers, or the first switch, the second switch, the third switch, and the feedback switch are implemented by using analog switch elements, digital switch elements, relays, or photocouplers.

In an embodiment, the driver module is a digital-to-analog conversion driver module and the collection module is an analog-to-digital conversion collection module.

In an embodiment, the digital-to-analog conversion driver module may be implemented by a dedicated digital-to-analog conversion chip, or by a micro-control unit with a digital-to-analog conversion function, and the analog-to-digital conversion collection module may be implemented by a dedicated analog-to-digital conversion chip, or by a micro-control unit with an analog-to-digital conversion function.

In an embodiment, the isolator may be implemented by using a photocoupler, a pulse transformer, a relay, or an isolation circuit composed of the photocoupler, the pulse transformer, or the relay.

According to a second aspect of the present disclosure, a time-division multiplexing control system applied to a distributed X-ray source is provided, including:

a plurality of time-division multiplexing control devices described above;

a collection module for receiving the working state data from one of the plurality of time-division multiplexing control devices, and sending the working state data;

a master control module for providing a first master control signal, providing the second master control signal to the one of the plurality of time-division multiplexing control devices, and receiving the working state data from the collection module;

a driver module for receiving the first master control signal from the master control module, and providing the drive signal to the one of the plurality of time-division multiplexing control devices according to the first master control signal; and a high-voltage source for providing the high-voltage signal.

In an embodiment, a control module of the one of the plurality of time-division multiplexing control devices provides the first control signal, the second control signal and the third control signal or provides the first control signal, the second control signal, the third control signal and the feedback control signal, under control of the second master control signal provided by the master control module.

In an embodiment, the time-division multiplexing control system further includes:

an isolator for isolating the master control module from the central processing unit module.

According to a third aspect of the present disclosure, a time-division multiplexing control system applied to a distributed X-ray source is provided, including:

a plurality of time-division multiplexing control devices described above;

a collection module for receiving the working state data from one of the plurality of time-division multiplexing control devices, and sending the working state data;

a master control module for providing the first control signal, the second control signal and the third control signal to the one of the plurality of time-division multiplexing control devices or providing the first control signal, the second control signal, the third control signal and the feedback control signal, providing a first master control signal, and receiving the working state data from the collection module;

a driver module for receiving the first master control signal from the master control module, and providing the drive signal to the one of the plurality of time-division multiplexing control devices according to the first master control signal; and a high-voltage source for providing the high-voltage signal.

In an embodiment, the time-division multiplexing control system further includes:

an isolator for isolating the master control module from the central processing unit module.

BRIEF DESCRIPTION OF THE DRAWINGS

Through the following description of the embodiments of the present disclosure with reference to the drawings, the above and other objectives, features, and advantages of the present disclosure will be apparent. In the drawings.

The drawings do not show all circuits or structures of the embodiments. The same reference numerals throughout the drawings indicate the same or similar parts or features.

DETAILED DESCRIPTION OF EMBODIMENTS

The embodiments of the present disclosure will be described with reference to the drawings. However, it should be understood that the descriptions are only exemplary, and are not intended to limit the scope of the present disclosure. In addition, in the following, descriptions of well-known structures and technologies are omitted to avoid unnecessarily obscuring the concept of the present disclosure.

The terms used herein are only for describing specific embodiments, and are not intended to limit the present disclosure. The terms "an", "a" and "the" used herein shall also include the meanings of "a plurality of" and "multiple", unless the context clearly dictates otherwise. In addition, the terms "including", "comprising", etc. used herein indicate the existence of features, steps, operations and/or components, but do not exclude the presence or addition of one or more other features, steps, operations or components.

All terms (including technical and scientific terms) used herein have the meanings commonly understood by those skilled in the art, unless otherwise defined. It should be noted that the terms used herein should be interpreted as having meanings consistent with the context of this specification, and should not be interpreted in an idealized or overly rigid manner.

Figure 1:
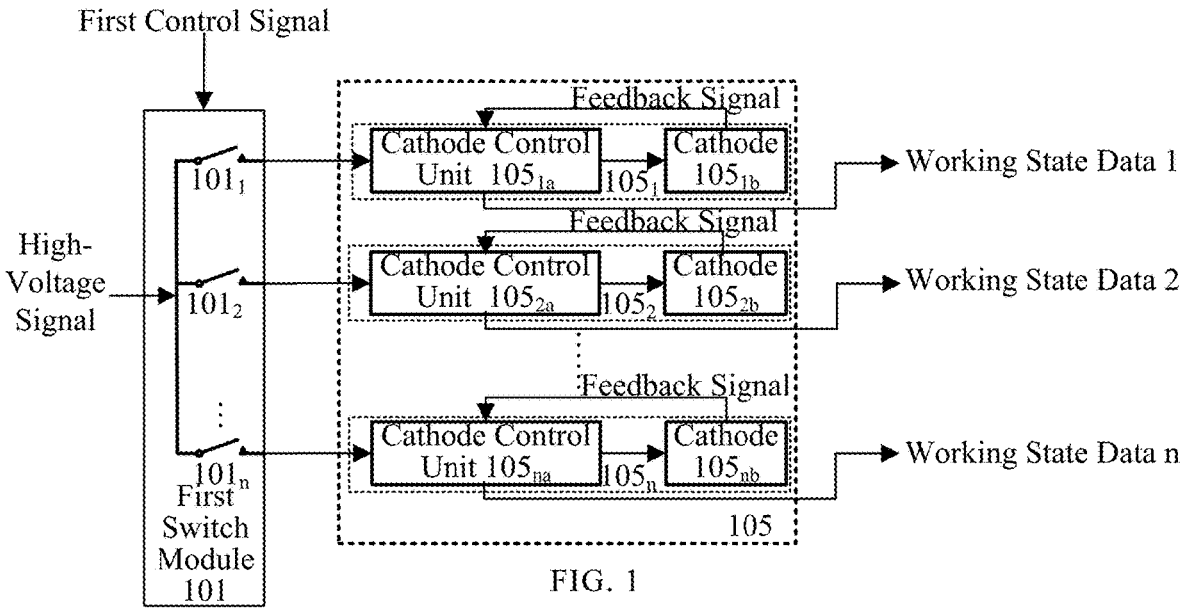
FIG. 1 shows a schematic diagram of a time-division multiplexing control device applied to a distributed X-ray source according to some embodiments of the present disclosure.

FIG. 1 shows a schematic diagram of a time-division multiplexing control device applied to a distributed X-ray source according to some embodiments of the present disclosure. The time-division multiplexing control device may include: a first switch module 101 and a cathode control module 105.

Figure 3:
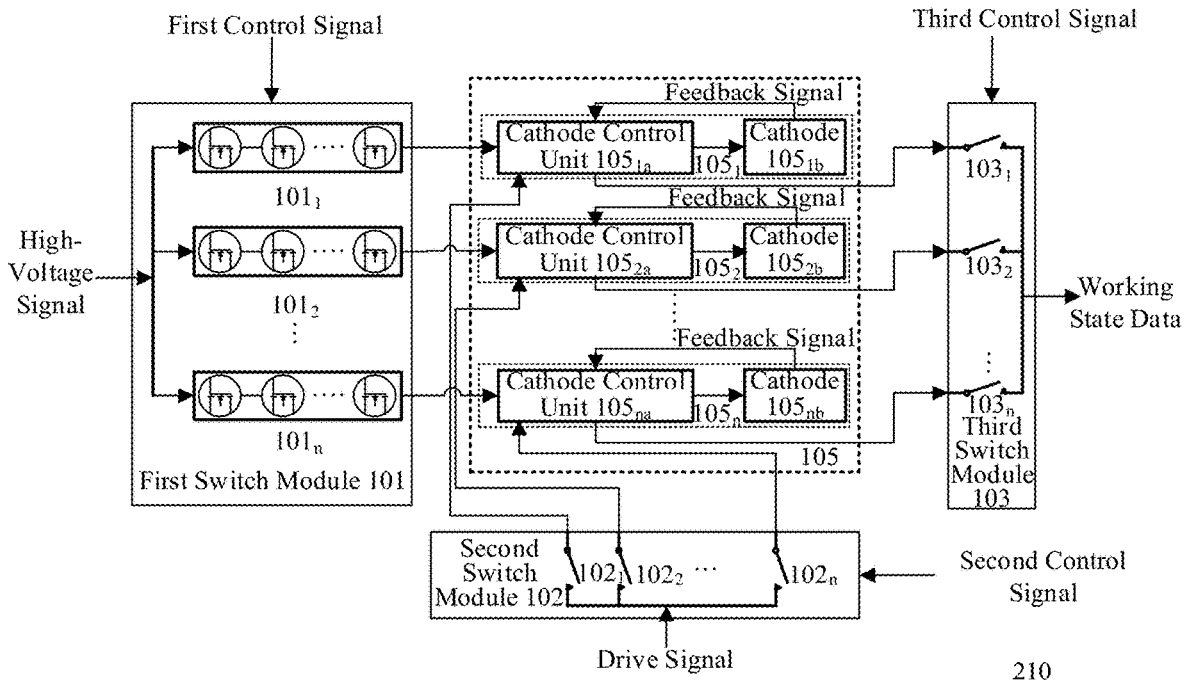
FIG. 3 shows a schematic diagram of yet another time-division multiplexing control device applied to a distributed X-ray source according to some embodiments of the present disclosure.

The first switch module 101 may include a plurality of first switches $\mathbf{101}_1$, $\mathbf{101}_2$ . . . $\mathbf{101}_n$, and the first switch module 101 may be used for receiving a high-voltage signal and a first control signal, selectively turning on one of the plurality of first switches according to the first control signal and sending the high-voltage signal through the first switch turned on. As shown in FIG. 3, each of the plurality of first switches may be formed by a plurality of metal oxide semiconductor (MOS) transistors in series. It should be noted that at the same moment, the first control signal may only turn on one first switch and the high-voltage signal is transmitted through the first switch turned on, whereas the other first switches are all turned off at this moment and thus the high-voltage signal may not be transmitted through the other switches. For example, when the first switch $\mathbf{101}_1$ is turned on through the first control signal, the high-voltage signal may be transmitted through the first switch $\mathbf{101}_1$, whereas the other first switches $\mathbf{101}_2$ . . . $\mathbf{101}_n$ are not used for transmitting the high-voltage signal.

The cathode control module 105 may include a plurality of cathode control stages $\mathbf{105}_1$, $\mathbf{105}_2$ . . . $\mathbf{105}_n$ in one-to-one correspondence with the plurality of first switches $\mathbf{101}_1$, $\mathbf{101}_2$ . . . $\mathbf{101}_n$, and may be used for receiving the high-voltage signal from the first switch module 101 and sending working state data, such as a working voltage and working current of a cathode, through a cathode control stage corresponding to the first switch turned on in the plurality of cathode control stages $\mathbf{105}_1$, $\mathbf{105}_2$ . . . $\mathbf{105}_n$. For example, when the first switch $\mathbf{101}_1$ is turned on through the first control signal, the high-voltage signal may be transmitted to the cathode control stage $\mathbf{105}_1$ through the first switch $\mathbf{101}_1$ turned on, and the cathode control stage $\mathbf{105}_1$ sends the working state data. Each cathode control stage may include a cathode control unit and a cathode. For example, the cathode control stage $\mathbf{105}_1$ may include a cathode control unit $\mathbf{105}_{1a}$ and a cathode $\mathbf{105}_{1b}$, the cathode control stage $\mathbf{105}_2$ may include a cathode control unit $\mathbf{105}_2$, and a cathode $\mathbf{105}_{2b}$, and so on. Correspondingly, the cathode control stage $\mathbf{105}_n$ may include a cathode control unit $\mathbf{105}_{na}$ and a cathode $\mathbf{105}_{nb}$. In the cathode control stage corresponding to the first switch turned on, the cathode control unit may be used to receive the high-voltage signal, send a drive control signal to the cathode, perform automatic feedback adjustment according to a feedback signal, and send the working state data; and the cathode may be used to send the feedback signal to the cathode control unit according to the drive control signal.

Figure 2:
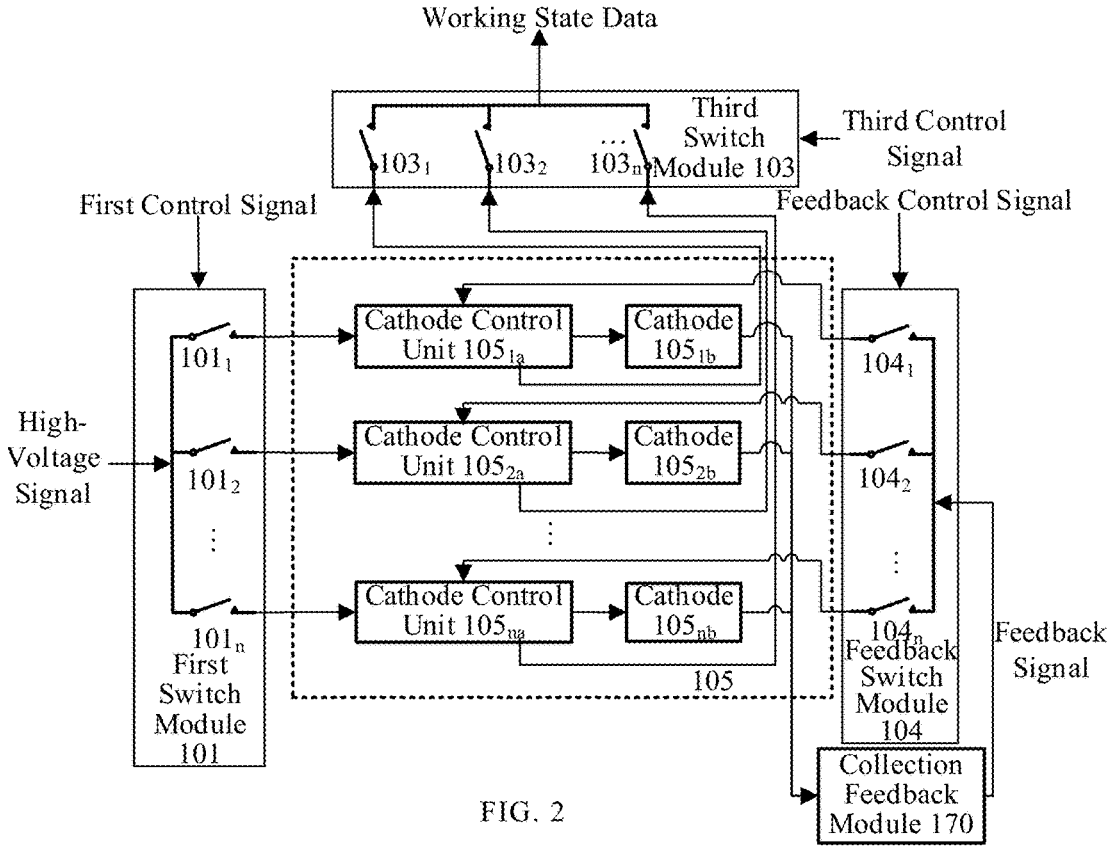
FIG. 2 shows a schematic diagram of another time-division multiplexing control device applied to a distributed X-ray source according to some embodiments of the present disclosure.

FIG. 2 shows a schematic diagram of another time-division multiplexing control device applied to the distributed X-ray source according to some embodiments of the present disclosure. The time-division multiplexing control device may include: the first switch module 101, the cathode control module 105, a collection feedback module 170, and a feedback switch module 104.

The first switch module 101 may include the plurality of first switches $\mathbf{101}_1$, $\mathbf{101}_2$ . . . $\mathbf{101}_n$, and the first switch module 101 may be used for receiving the high-voltage signal and the first control signal, selectively turning on one of the plurality of first switches according to the first control signal and sending the high-voltage signal through the first switch turned on. As shown in FIG. 3, each of the plurality of first switches may be formed by a plurality of metal oxide semiconductor (MOS) transistors in series. It should be noted that at the same moment, the first control signal may only turn on one first switch and the high-voltage signal is transmitted through the first switch turned on, whereas the other first switches are all turned off at this moment and thus the high-voltage signal may not be transmitted through the other switches. For example, when the first switch $\mathbf{101}_1$ is turned on through the first control signal, the high-voltage signal may be transmitted through the first switch $\mathbf{101}_1$, whereas the other first switches $\mathbf{101}_2$ . . . $\mathbf{101}_n$ are not used for transmitting the high-voltage signal.

The cathode control module 105 may include the plurality of cathode control stages $\mathbf{105}_1$, $\mathbf{105}_2$ . . . $\mathbf{105}_n$ in one-to-one correspondence with the plurality of first switches $\mathbf{101}_1$, $\mathbf{101}_2$ . . . $\mathbf{101}_n$, and may be used for receiving the high-voltage signal from the first switch module 101 and sending the working state data, such as the working voltage and working current of the cathode, through the cathode control stage corresponding to the first switch turned on in the plurality of cathode control stages $\mathbf{105}_1$, $\mathbf{105}_2$ . . . $\mathbf{105}_n$. For example, when the first switch $\mathbf{101}_1$ is turned on through the first control signal, the high-voltage signal may be transmitted to the cathode control stage $\mathbf{105}_1$ through the first switch $\mathbf{101}_1$ turned on, and the cathode control stage $\mathbf{105}_1$ sends the working state data. Each cathode control stage may include a cathode control unit and a cathode. For example, the cathode control stage $\mathbf{105}_1$ may include the cathode control unit $\mathbf{105}_{1a}$ and the cathode $\mathbf{105}_{1b}$, the cathode control stage $\mathbf{105}_2$ may include the cathode control unit $\mathbf{105}_2$ and the cathode $\mathbf{105}_{2b}$, and so on. Correspondingly, the cathode control stage $\mathbf{105}_n$ may include the cathode control unit $\mathbf{105}_{na}$ and the cathode $\mathbf{105}_{nb}$.

The collection feedback module 170 may be used to receive the feedback signal from the cathode control module 105 and send the feedback signal. The feedback switch module 104 may include a plurality of feedback switches $\mathbf{104}_1$, $\mathbf{104}_2$ . . . $\mathbf{104}_n$, and is used for receiving a feedback control signal, receiving the feedback signal from the collection feedback module 170, selectively turning on one of the plurality of feedback switches according to the feedback control signal, and sending the feedback signal to the cathode control module 105 through the feedback switch turned on. The feedback switch may be implemented by using an analog switch element, a digital switch element, a relay or a photocoupler. The feedback switch module 104 may be coupled with the cathode control stages $\mathbf{105}_1$, $\mathbf{105}_2$ . . . $\mathbf{105}_n$. It should be noted that at the same moment, the feedback control signal may only turn on one feedback switch and the feedback signal is transmitted through a corresponding feedback switch, whereas the other feedback switches are all turned off at this moment and thus the feedback signal may not be transmitted through the other switches. For example, when the feedback switch $\mathbf{104}_1$ is turned on through the feedback control signal, the feedback signal may be transmitted to the cathode control stage $\mathbf{105}_1$ through the feedback switch $\mathbf{104}_1$, whereas the other feedback switches $\mathbf{104}_2$ . . . $\mathbf{104}_n$ are not used for transmitting the feedback signal. In the cathode control stage corresponding to the first switch turned on, the cathode control unit may be used to: receive the high-voltage signal and the feedback signal, send the drive control signal to the cathode, perform the automatic feedback adjustment according to the feedback signal, and send the working state data; and the cathode may be used to send the feedback signal to the collection feedback module 170 according to the drive control signal.

It should be noted that the first control signal and the feedback control signal may be provided so that the first switch turned on and the feedback switch turned on are coupled with the same cathode control stage. For example, when a first switch is turned on to couple with the cathode control stage $\mathbf{105}_1$ through the first control signal, a corresponding feedback switch may be turned on through the feedback control signal to couple with the cathode control stage $\mathbf{105}_1$.

As shown in FIG. 3, the time-division multiplexing control device may further include a second switch module 102. The second switch module 102 may include a plurality of second switches $\mathbf{102}_1$, $\mathbf{102}_2$ . . . $\mathbf{102}_n$ in one-to-one correspondence with the plurality of cathode control stages $\mathbf{105}_1$, $\mathbf{105}_2$ . . . $\mathbf{105}_n$, and is used for receiving a drive signal and a second control signal, selectively turning on one of the plurality of second switches and sending the drive signal through the second switch turned on. The second switch may be implemented by using an analog switch element, a digital switch element, a relay or a photocoupler. It should be noted that at the same moment, the second control signal may only turn on one second switch and the drive signal is transmitted through a corresponding second switch, whereas the other second switches are all turned off at this moment and thus the drive signal may not be transmitted through the other second switches. For example, when the second switch $\mathbf{102}_1$ is turned on through the second control signal, the drive signal may be transmitted to the cathode control stage $\mathbf{105}_1$ through the second switch $\mathbf{102}_1$, whereas the other second switches $\mathbf{102}_2$ . . . $\mathbf{102}_n$ are not used for transmitting the drive signal. The cathode control module 105 may be further used to: receive the drive signal from the second switch module 102, and transmit the working state data through one of the plurality of cathode control stages corresponding to the first switch turned on and the second switch turned on.

It should be noted that the first control signal and the second control signal may be provided so that the first switch turned on and the second switch turned on are coupled with the same cathode control stage. For example, when a first switch is turned on to couple with the cathode control stage $\mathbf{105}_1$ through the first control signal, a corresponding second switch should be turned on to couple with the cathode control stage $\mathbf{105}_1$ through the second control signal.

As shown in FIG. 3, the time-division multiplexing control device may further include a third switch module 103 including a plurality of third switches $\mathbf{103}_1$, $\mathbf{103}_2$ . . . $\mathbf{103}_n$ in one-to-one correspondence with the plurality of cathode control stages $\mathbf{105}_1$, $\mathbf{105}_2$ . . . $\mathbf{105}_n$. The third switch module 103 is used for receiving a third control signal, receiving the working state data from the cathode control module 105, selectively turning on one of the plurality of third switches according to the third control signal and sending the working state data through the third switch turned on. The third switch may be implemented by using an analog switch element, a digital switch element, a relay or a photocoupler. It should be noted that at the same moment, the third control signal may only turn on one third switch and the working state data is received through a corresponding third switch, whereas the other third switches are all turned off at this moment and thus the working state data may not be received through the other third switches. For example, when the third switch $\mathbf{103}_1$ is turned on through the third control signal, the working state data may be received from the cathode control stage $\mathbf{105}_1$ through the third switch $\mathbf{103}_1$, whereas the other third switches $\mathbf{103}_2 \ldots \mathbf{103}_n$ are not used for receiving the working state data.

It should be noted that the first control signal, the second control signal, and the third control signal may be provided so that the first switch turned on, the second switch turned on, and the third switch turned on are coupled with the same cathode control stage. For example, when a first switch is turned on to couple with the cathode control stage $\mathbf{105}_1$ through the first control signal, a corresponding second switch should be turned on to couple with the cathode control stage $\mathbf{105}_1$ through the second control signal, and a corresponding third switch should be turned on to couple with the cathode control stage $\mathbf{105}_1$ through the third control signal.

Figure 4:
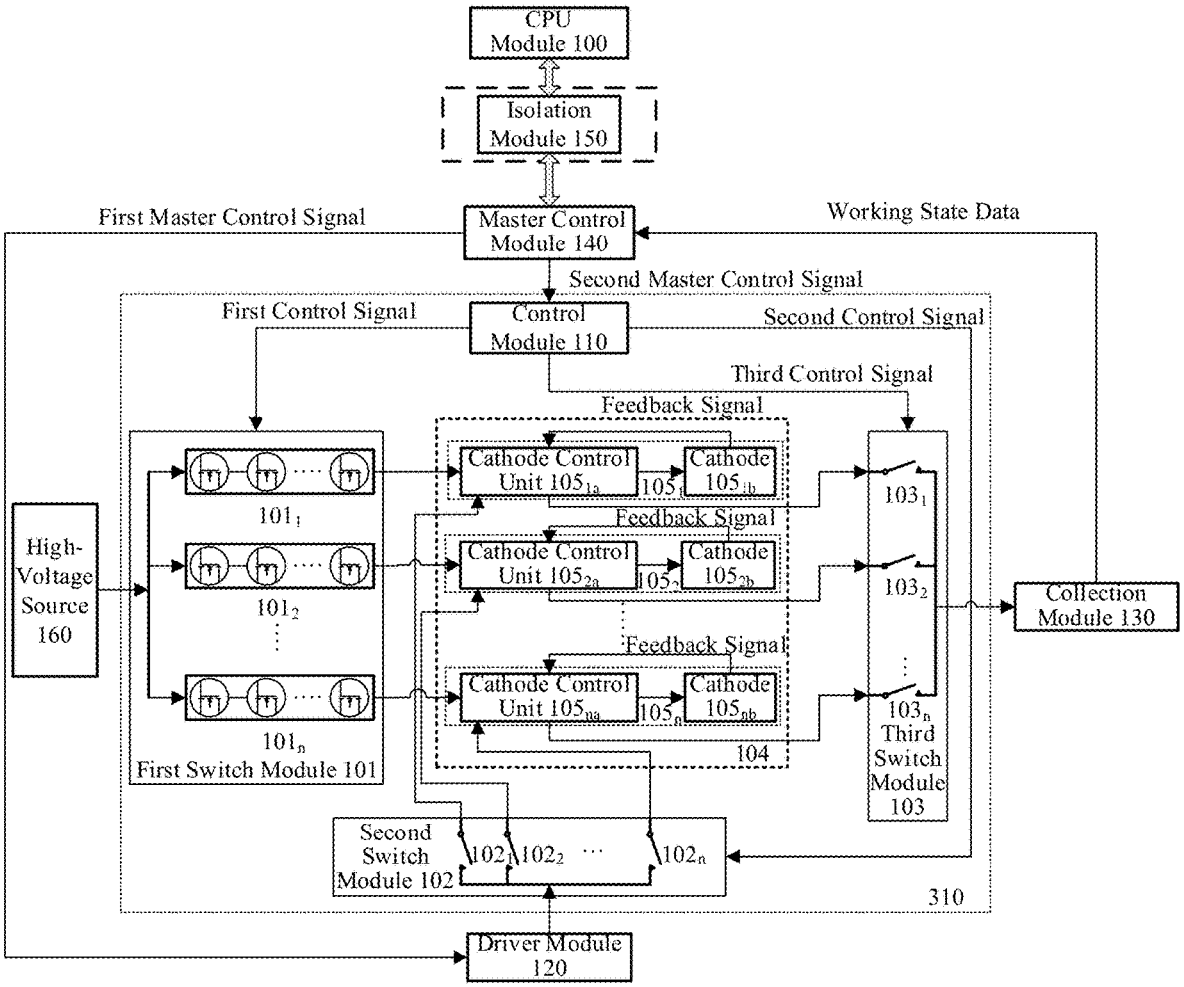
FIG. 4 shows a schematic diagram of a time-division multiplexing control system applied to a distributed X-ray source according to some embodiments of the present disclosure.

As shown in FIG. 4, the time-division multiplexing control device may further include a control module 110 for providing the first control signal to the first switch module 101, the second control signal to the second switch module 102, and the third control signal to the third switch module 103, under a control of a second master control signal. Specifically, the control module 110 may be coupled with the first switch module 101, the second switch module 102 and the third switch module 103, and the control module 110 may turn on the first switch in the first switch module 101 by providing the first control signal to the first switch module 101, turn on the second switch in the second switch module 102 by providing the second control signal to the second switch module 102, and turn on the third switch in the third switch module 103 by providing the third control signal to the third switch module 103.

As shown in FIG. 4, the time-division multiplexing control device may further include: a collection module 130 for receiving the working state data from the third switch module 103 and sending the working state data; a master control module 140 for providing a first master control signal, providing the second master control signal to the control module 110, and receiving the working state data from the collection module 130; a driver module 120 for receiving the first master control signal from the master control module 140, and providing the drive signal to the second switch module 102 according to the first master control signal; and a high-voltage source 160 for providing the high-voltage signal. Specifically, the master control module 140 may be respectively coupled with the driver module 120 and the collection module 130, to control the driver module 120 to generate the drive signal, and to receive the working state data from the collection module 130 in real time. The driver module 120 may be a digital-to-analog conversion driver module, and the digital-to-analog conversion driver module may be implemented by a dedicated digital-to-analog conversion chip, or by a micro-control unit with a digital-to-analog conversion function. The collection module 130 may be an analog-to-digital conversion collection module, and the analog-to-digital conversion collection module may be implemented by a dedicated analog-to-digital conversion chip, or by a micro-control unit with an analog-to-digital conversion function.

The master control module 140 may also control the operation of the control module 110 through the second master control signal, so that the control module 110 provides the first control signal, the second control signal, and the third control signal, under the control of the master control module 140.

As shown in FIG. 4, the time-division multiplexing control device may further include an isolator 150 for isolating the master control module 140 from the central processing unit (CPU) module 100, so that the time-division multiplexing control device may operate in a high-voltage (kilovolt level) operation environment. The isolator 150 may be implemented by using a photocoupler, a pulse transformer, a relay, or an isolation circuit composed of the photocoupler, the pulse transformer, or the relay.

Figure 5:
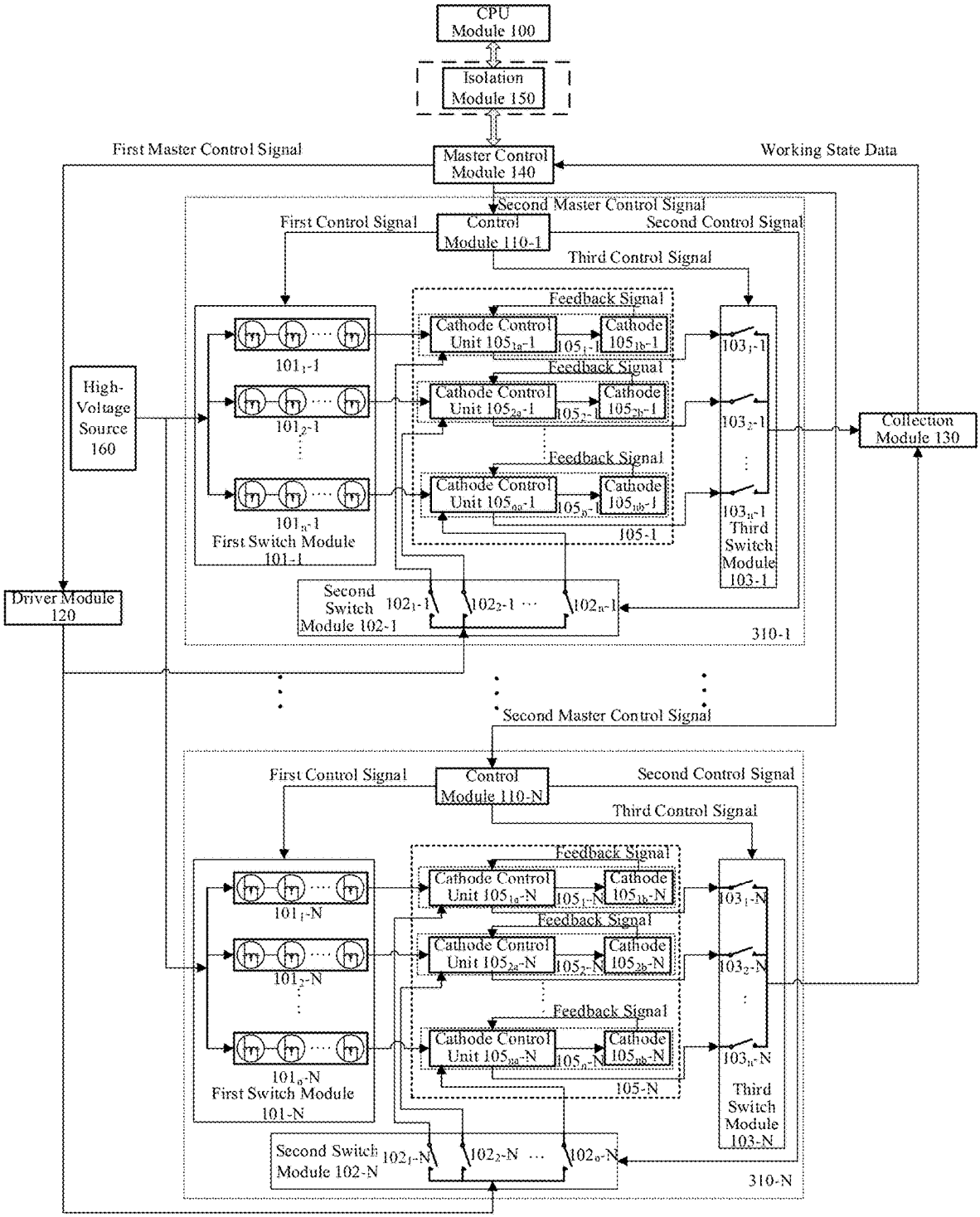
FIG. 5 shows a schematic diagram of another time-division multiplexing control system applied to a distributed X-ray source according to some embodiments of the present disclosure.

FIG. 5 shows a schematic diagram of a time-division multiplexing control system applied to a distributed X-ray source according to some embodiments of the present disclosure. The time-division multiplexing control system may include: a plurality of time-division multiplexing control devices 310 (as shown in FIG. 4); a collection module 130 for receiving the working state data from one of the plurality of time-division multiplexing control devices and sending the working state data; a master control module 140 for providing the first master control signal, providing the second master control signal to the one of the plurality of time-division multiplexing control devices 310, and receiving the working state data from the collection module 130; a driver module 120 for receiving the first master control signal from the master control module 140, and providing the drive signal to the one of the plurality of time-division multiplexing control devices according to the first master control signal; and a high-voltage source for providing the high-voltage signal. The driver module 120 may be a digital-to-analog conversion driver module, and the digital-to-analog conversion driver module may be implemented by a dedicated digital-to-analog conversion chip, or by a micro-control unit with a digital-to-analog conversion function. The collection module 130 may be an analog-to-digital conversion collection module, and the analog-to-digital conversion collection module may be implemented by a dedicated analog-to-digital conversion chip, or by a micro-control unit with an analog-to-digital conversion function. The first switch, the second switch, and the third switch in the time-division multiplexing control device 310 may be implemented by analog switching elements, digital switching elements, relays or photocouplers.

A control module in the one of the plurality of time-division multiplexing control devices 310 (i.e., a time-division multiplexing control device 310-1 . . . a time-division multiplexing control device 310-N) may provide the first control signal, the second control signal, and the third control signal, under the control of the second master control signal provided by the master control module 140.

The time-division multiplexing control system may further include: the isolator 150 for isolating the master control module 140 from the central processing unit (CPU) module 100, so that the time-division multiplexing control system may operate in a high-voltage (kilovolt level) operation environment. The isolator 150 may be implemented by using a photocoupler, a pulse transformer, a relay, or an isolation circuit composed of the photocoupler, the pulse transformer, or the relay.

As shown in FIG. 5, the isolation module 150 may be coupled with the master control module 140, the master control module 140 may be coupled with a control module 110-1 . . . a control module 110-N, and at the same time, the master control module 140 may be coupled with the driver module 120 and the collection module 130. The driver module 120 may be coupled with a second switch module 102-1 . . . a second switch module 102-N, the collection module 130 may be coupled with a third switch module 103-1 . . . a third switch module 103-N, and the high-voltage source 160 may be coupled with a first switch module 101-1 . . . a first switch module 101-N.

In the time-division multiplexing control device 310-1, the first switch module 101-1 may be coupled with a cathode control unit $\mathbf{105}_{1a}$-1, a cathode control unit $\mathbf{105}_{2a}$-1 . . . a cathode control unit $\mathbf{105}_{na}$-1, and the first switch module 101-1 may be coupled with the control module 110-1 at the same time; the second switch module 102-1 may be coupled with the cathode control unit $\mathbf{105}_{1a}$-1, the cathode control unit $\mathbf{105}_{2a}$-1 . . . the cathode control unit $\mathbf{105}_{na}$-1, and the second switch module 102-1 may be coupled with the control module 110-1; and the third switch module 103-1 may be coupled with the cathode control unit $\mathbf{105}_{1a}$-1, the cathode control unit $\mathbf{105}_{2a}$-1 . . . the cathode control unit $\mathbf{105}_{na}$-1, and the third switch module 103-1 may be coupled with the control module 110-1.

Similarly, in the time-division multiplexing control device 310-N, the first switch module 101-N may be coupled with a cathode control unit $\mathbf{105}_{1a}$-N, a cathode control unit $\mathbf{105}_{2a}$-N . . . a cathode control unit $\mathbf{105}_{na}$-N, and the first switch module 101-N may be coupled with the control module 110-N at the same time; the second switch module 102-N may be coupled with the cathode control unit $\mathbf{105}_{1a}$-N, the cathode control unit $\mathbf{105}_{2a}$-N . . . the cathode control unit $\mathbf{105}_{na}$-N, and the second switch module 102-N may be coupled with the control module 110-N; and the third switch module 103-N may be coupled with the cathode control unit $\mathbf{105}_{1a}$-N, the cathode control unit $\mathbf{105}_{2a}$-N . . . the cathode control unit $\mathbf{105}_{na}$-N, and the third switch module 103-N may be coupled with the control module 110-N.

Other time-division multiplexing control devices not shown in FIG. 5 may have a similar structure to the time-division multiplexing control device 310-1 and the time-division multiplexing control device 310-N, and thus may not be repeated here.

The master control module 140 may control the operation of the time-division multiplexing control device 310-1 . . . the time-division multiplexing control device 310-N through the control module 110-1, the control module 110-2 . . . the control module 110-N, respectively, where only one control module may be controlled at the same moment. The operation of the time-division multiplexing control system will be described below by taking the master control module 140 controlling the time-division multiplexing control device 310-1 as an example.

The high-voltage source 160 may output the high-voltage signal to the first switch module 101-1. The master control module 140 may control the driver module 120 to output a drive signal, and the drive signal may be output to the second switch module 102-1. The master control module 140 may control the control module 110-1 to provide the first control signal, the second control signal and the third control signal. The control module 110-1 may output the first control signal to the first switch module 101-1 to turn on one switch in the first switch module 101-1. It should be noted that at the same moment, the first control signal may only turn on one first switch in the first switch module 101-1 and the high-voltage signal is transmitted through the first switch turned on, whereas the other first switches are all turned off at this moment and thus the high-voltage signal may not be transmitted through the other first switches. For example, when the first switch $\mathbf{101}_2$-1 is turned on, the high-voltage signal may be transmitted to the cathode control stage $\mathbf{105}_2$-1 through the first switch $\mathbf{101}_2$-1. The control module 110-1 may output the second control signal to the second switch module 102-1, to turn on a corresponding second switch in the second switch module 102-1. The control module 110-1 may output the third control signal to the third switch module 103-1, to turn on a corresponding third switch in the third switch module 103-1. It should be noted that the first control signal is provided to turn on the first switch $\mathbf{101}_2$-1, so that the second control signal and the third control signal are provided to turn on the second switch $\mathbf{102}_2$-1 and the third switch $\mathbf{103}_2$-1, which may enable the first switch turned on, the second switch turned on, and the third switch turned on to couple with the same cathode control stage $\mathbf{105}_2$-1. The cathode control unit $\mathbf{105}_2$-1 in the cathode control stage $\mathbf{105}_2$-1 sends the drive control signal to the cathode $\mathbf{105}_{2b}$-1 according to the received drive signal and high-voltage signal, and the cathode $\mathbf{105}_{2b}$-1 sends the feedback signal to the cathode control unit $\mathbf{105}_{2a}$ according to the received drive control signal. The cathode control unit $\mathbf{105}_{2a}$-1 performs the automatic feedback adjustment according to the received feedback signal, outputs the working state data, and transmits the working state data to the collection module 130 through the third switch $\mathbf{103}_2$-1 turned on. The collection module 130 may transmit the working state data to the master control module 140.

In a case where the master control module selects another time-division multiplexing control device (e.g., the time-division multiplexing control device 310-N), the operation process of the time-division multiplexing control system may be similar to the above-mentioned process, and thus it may not be repeated here.

Figure 6:
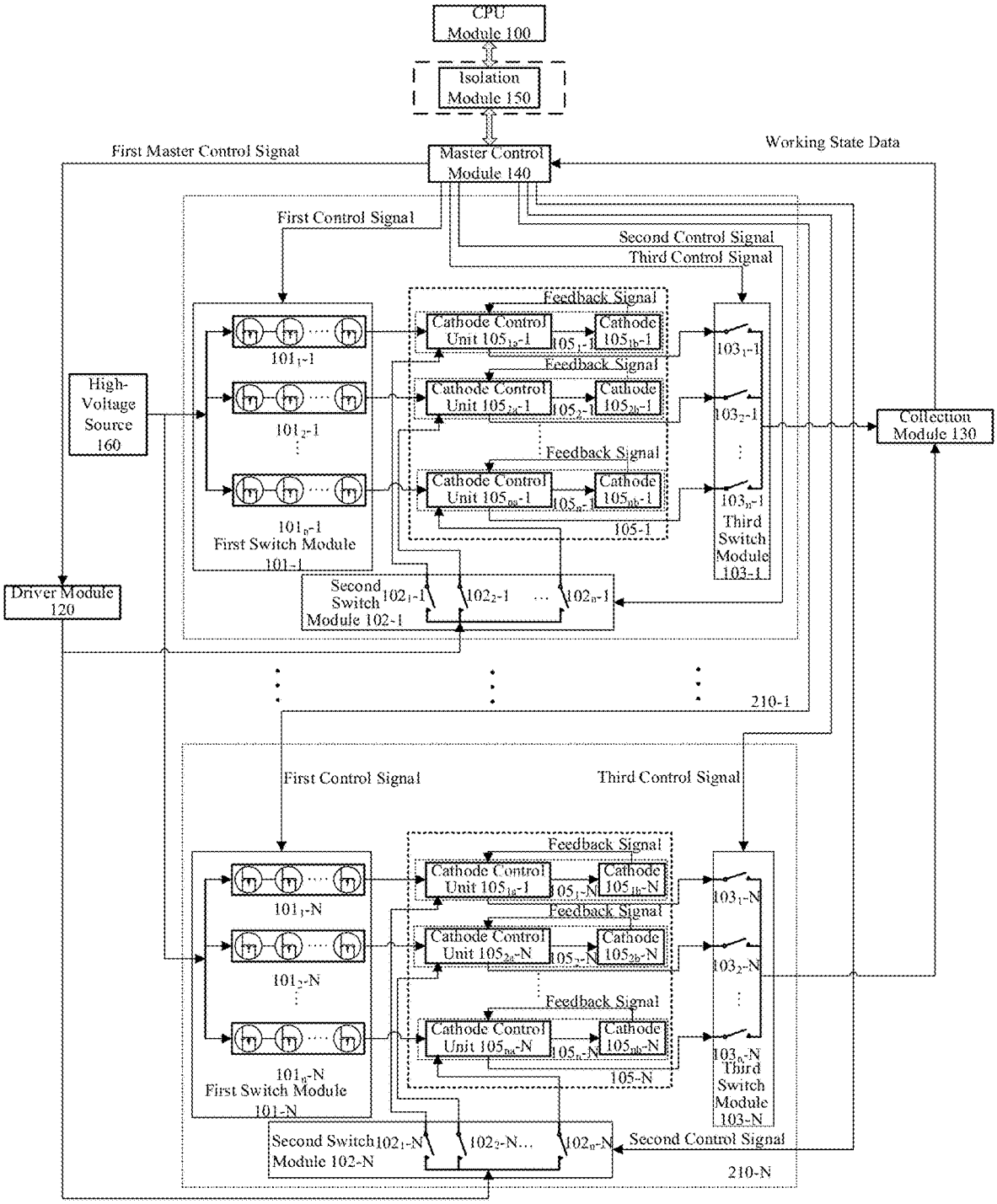
FIG. 6 shows a schematic diagram of a time-division multiplexing control device applied to a distributed X-ray source according to some embodiments of the present disclosure.

FIG. 6 shows a schematic diagram of another time-division multiplexing control device applied to a distributed X-ray source according to some embodiments of the present disclosure. The time-division multiplexing control system may include: a plurality of time-division multiplexing control devices 210 (as shown in FIG. 3); the collection module 130 for receiving the working state data from one of the plurality of time-division multiplexing control devices, and sending the working state data; the master control module 140 for providing the first control signal, the second control signal and the third control signal to the one of the plurality of time-division multiplexing control devices, providing the first master control signal, and receiving the working state data from the collection module 130; the driver module 120 for receiving the first master control signal from the master control module 140, and providing the drive signal to the one of the plurality of time-division multiplexing control devices according to the first master control signal; and the high-voltage source for providing the high-voltage signal. The driver module 120 may be a digital-to-analog conversion driver module, and the digital-to-analog conversion driver module may be implemented by a dedicated digital-to-analog conversion chip, or by a micro-control unit with a digital-to-analog conversion function. The collection module 130 may be an analog-to-digital conversion collection module, and the analog-to-digital conversion collection module may be implemented by a dedicated analog-to-digital conversion chip, or by a micro-control unit with an analog-to-digital conversion function. The first switch, the second switch, and the third switch in the time-division multiplexing control device 210 may be implemented by analog switching elements, digital switching elements, relays or photocouplers.

The time-division multiplexing control system may further include: the isolator 150 for isolating the master control module 140 from the central processing unit (CPU) module 100, so that the time-division multiplexing control system may operate in a high-voltage (kilovolt level) operation environment. The isolator 150 may be implemented by using a photocoupler, a pulse transformer, a relay, or an isolation circuit composed of the photocoupler, the pulse transformer, or the relay.

As shown in FIG. 6, the isolation module 150 may be coupled with the master control module 140, the master control module 140 may be coupled with the first switch module 101-1 . . . the first switch module 101-N, the second switch module 102-1 . . . the second switch module 102-N, and the third switch module 103-1 . . . and the third switch module 103-N; and the master control module 140 may be coupled with the driver module 120 and the collection module 130 at the same time. The driver module 120 may be coupled with the second switch module 102-1 . . . the second switch module 102-N, the collection module 130 may be coupled with the third switch module 103-1 . . . the third switch module 103-N, and the high-voltage source 160 may be coupled with the first switch module 101-1 . . . the first switch module 101-N.

In the time-division multiplexing control device 210-1, the first switch module 101-1 may be coupled with the cathode control unit $\mathbf{105}_{1a}$-1, the cathode control unit $\mathbf{105}_{2a}$-1 . . . the cathode control unit $\mathbf{105}_{na}$-1; the second switch module 102-1 may be coupled with the cathode control unit $\mathbf{105}_{1a}$-1, the cathode control unit $\mathbf{105}_{2a}$-1 . . . the cathode control unit $\mathbf{105}_{na}$-1; and the third switch module 103-1 may be coupled with the cathode control unit $\mathbf{105}_{1a}$-1, the cathode control unit $\mathbf{105}_{2a}$-N . . . the cathode control unit $\mathbf{105}_{na}$-1.

Similarly, in the time-division multiplexing control device 210-N, the first switch module 101-1 may be coupled with the cathode control unit $\mathbf{105}_{1}$a-N, the cathode control unit $\mathbf{105}_{2a}$-N . . . the cathode control unit $\mathbf{105}_{na}$-N; the second switch module 102-N may be coupled with the cathode control unit $\mathbf{105}_{1a}$-N, the cathode control unit $\mathbf{105}_{2a}$-N . . . the cathode control unit $\mathbf{105}_{na}$-N; and the third switch module 103-N may be coupled with the cathode control unit $\mathbf{105}_{1a}$-N, the cathode control unit $\mathbf{105}_{2a}$-N . . . the cathode control unit $\mathbf{105}_{na}$-N.

Other time-division multiplexing control devices not shown in FIG. 6 may have a similar structure to the time-division multiplexing control device 210-1 and the time-division multiplexing control device 210-N, and thus may not be repeated here.

The master control module 140 may control the operation of the time-division multiplexing control device 210-1 . . . the time-division multiplexing control device 210-N, respectively, where only one time-division multiplexing control device may be controlled at the same moment. The operation of the time-division multiplexing control system will be described below by taking the master control module 140 controlling the time-division multiplexing control device 210-1 as an example.

The high-voltage source 160 may output the high-voltage signal to the first switch module 101-1. The master control module 140 may control the driver module 120 to output the drive signal, and the drive signal may be output to the second switch module 102-1. The master control module 140 may output the first control signal to the first switch module 101-1 to turn on one switch in the first switch module 101-1. It should be noted that at the same moment, the first control signal may only turn on one first switch in the first switch module 101-1 and the high-voltage signal is transmitted through the first switch turned on, whereas the other first switches are all turned off at this moment and thus the high-voltage signal may not be transmitted through the other first switches. For example, when the first switch $\mathbf{101}_{2}$-1 is turned on, the high-voltage signal may be transmitted to the cathode control stage $\mathbf{105}_{2}$-1 through the first switch $\mathbf{101}_{2}$-1. The master control module 140 may output the second control signal to the second switch module 102-1, to turn on a corresponding second switch in the second switch module 102-1. The master control module 140 may output the third control signal to the third switch module 103-1, to turn on a corresponding third switch in the third switch module 103-1. It should be noted that the first control signal is provided to turn on the first switch $\mathbf{101}_{2}$-1, so that the second control signal and the third control signal are provided to turn on the second switch $\mathbf{102}_{2}$-1 and the third switch $\mathbf{103}_{2}$-1, which may enable the first switch turned on, the second switch turned on, and the third switch turned on to couple with the same cathode control stage $\mathbf{105}_{2}$-1. The cathode control unit $\mathbf{105}_{2a}$-1 in the cathode control stage $\mathbf{105}_{2}$-1 sends the drive control signal to the cathode $\mathbf{105}_{2b}$-1 according to the received drive signal and high-voltage signal, and the cathode $\mathbf{105}_{2b}$-1 sends the feedback signal to the cathode control unit $\mathbf{105}_{2a}$ according to the received drive control signal. The cathode control unit $\mathbf{105}_{2a}$-1 performs the automatic feedback adjustment according to the received feedback signal, outputs the working state data, and transmits the working state data to the collection module 130 through the third switch $\mathbf{103}_{2}$-1 turned on. The collection module 130 may transmit the working state data to the master control module 140.

In a case where the master control module selects another time-division multiplexing control device (e.g., the time-division multiplexing control device 210-N), the operation process of the time-division multiplexing control system may be similar to the above process, and thus it may not be repeated here.

Figure 7:
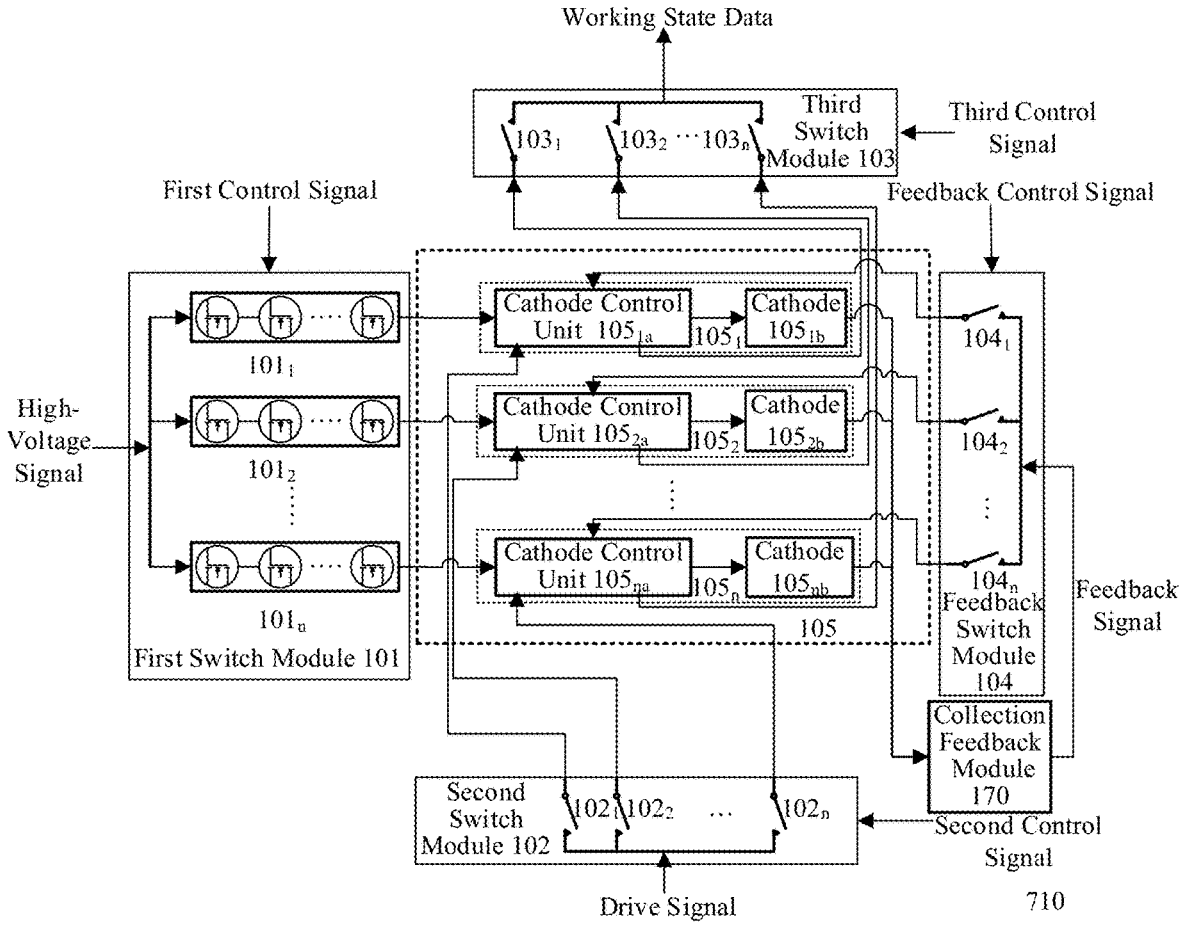
FIG. 7 shows a schematic diagram of another time-division multiplexing control device applied to a distributed X-ray source according to some embodiments of the present disclosure.

As shown in FIG. 7, the time-division multiplexing control device includes: a first switch module 101, a cathode control module 105, a collection feedback module 170, a feedback switch module 104, and a second switch module 102. The second switch module 102 may include a plurality of second switches $\mathbf{102}_{1}$, $\mathbf{102}_{2}$ . . . $\mathbf{102}_{n}$ in one-to-one correspondence with the plurality of cathode control stages $\mathbf{105}_{1}$, $\mathbf{105}_{2}$ . . . $\mathbf{105}_{n}$, and may be used for receiving the drive signal and the second control signal, selectively turning on one of the plurality of second switches according to the second control signal and sending the drive signal through the second switch turned on. The second switch may be implemented by using an analog switching element, a digital switching element, a relay or a photocoupler. It should be noted that at the same moment, the second control signal may only turn on one second switch and the drive signal is transmitted through a corresponding second switch, whereas the other second switches are all turned off at this moment and thus the drive signal may not be transmitted through the other switches. For example, when the second switch $\mathbf{102}_{1}$ is turned on through the second control signal, the drive signal may be transmitted to the cathode control stage $\mathbf{105}_{1}$ through the second switch $\mathbf{102}_{1}$, whereas the other second switches $\mathbf{102}_{2}$ . . . $\mathbf{102}_{n}$ are not used for transmitting the drive signal. The cathode control module 105 may be further used to: receive the drive signal from the second switch module 102, and transmit the working state data through one of the plurality of cathode control stages corresponding to the first switch turned on and the second switch turned on.

It should be noted that the first control signal, the second control signal, and the feedback control signal may be provided so that the first switch turned on and the second switch turned on are coupled with the same cathode control stage. For example, when a first switch is turned on to couple with the cathode control stage $105_1$ through the first control signal, a corresponding second switch should be turned on to couple with the cathode control stage $105_1$ through the second control signal, and a corresponding feedback switch should be turned on to couple with the cathode control stage $105_1$ through the feedback control signal.

As shown in FIG. 7, the time-division multiplexing control device may further include the third switch module 103 including the plurality of third switches $103_1$, $103_2$ . . . $103_n$ in one-to-one correspondence with the plurality of cathode control stages $105_1$, $105_2$ . . . $105_n$. The third switch module 103 is used for receiving the third control signal, receiving the working state data from the cathode control module 105, selectively turning on one of the plurality of third switches according to the third control signal, and sending the working state data through the third switch turned on. The third switch may be implemented by using an analog switch element, a digital switch element, a relay or a photocoupler. The third switch module 103 may be coupled with the cathode control stages $105_1$, $105_2$ . . . $105_n$. It should be noted that at the same moment, the third control signal may only turn on one third switch and the working state data is received through a corresponding third switch, whereas the other third switches are all turned off at this moment and thus the working state data may not be received through the other switches. For example, when the third switch $103_1$ is turned on through the third control signal, the working state data may be received from the cathode control stage $105_1$ through the third switch $103_1$, whereas the other third switches $103_2$ . . . $103_n$ are not used for receiving the working state data.

It should be noted that the first control signal, the second control signal, the third control signal, and the feedback control signal may be provided so that the first switch turned on, the second switch turned on, the third switch turned on and the feedback switch turned on are coupled with the same cathode control stage. For example, when a first switch is turned on to couple with the cathode control stage $105_1$ through the first control signal, a corresponding second switch should be turned on to couple with the cathode control stage $105_1$ through the second control signal, a corresponding third switch should be turned on to couple with the cathode control stage $105_1$ through the third control signal, and a corresponding feedback switch should be turned on to couple with the cathode control stage $105_1$ through the feedback control signal.

Figure 8:
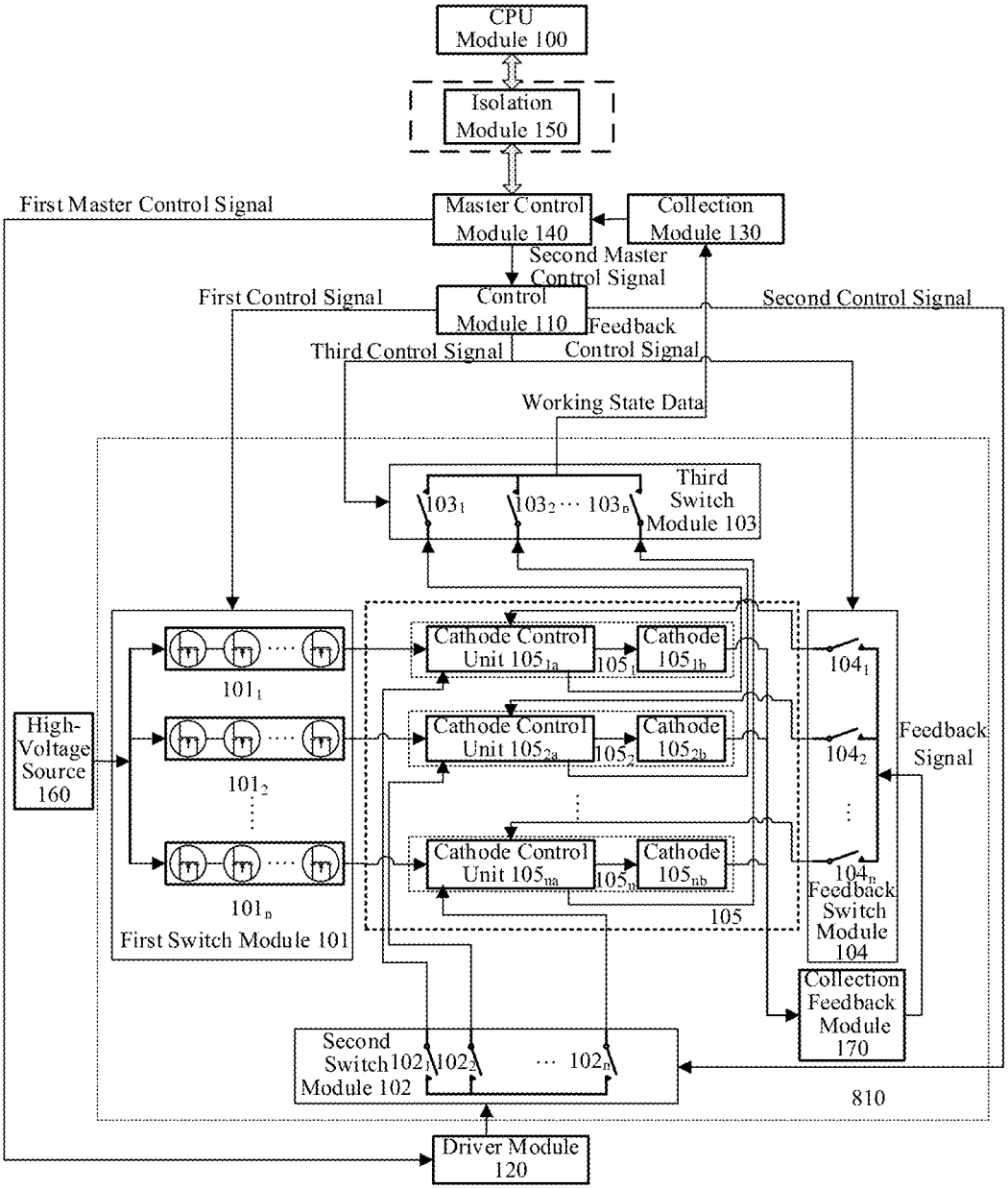
FIG. 8 shows a schematic diagram of yet another time-division multiplexing control device applied to a distributed X-ray source according to some embodiments of the present disclosure.

As shown in FIG. 8, the time-division multiplexing control device may further include the control module 110 for providing the first control signal to the first switch module 101, the second control signal to the second switch module 102, the third control signal to the third switch module 103, and the feedback control signal to the feedback switch module 104, under the control of the second master control signal. Specifically, the control module 110 may be coupled with the first switch module 101, the second switch module 102, the third switch module 103 and the feedback switch module 104, and the control module 110 may turn on the first switch in the first switch module 101 by providing the first control signal to the first switch module 101, turn on the second switch in the second switch module 102 by providing the second control signal to the second switch module 102, turn on the third switch in the third switch module 103 by providing the third control signal to the third switch module 103, and turn on the feedback switch in the feedback switch module 104 by providing the feedback control signal to the feedback switch module 104.

As shown in FIG. 8, the time-division multiplexing control device may further include: the collection module 130 for receiving the working state data from the third switch module 103 and sending the working state data; the master control module 140 for providing the first master control signal, providing the second master control signal to the control module 110, and receiving the working state data from the collection module 130; the driver module 120 for receiving the first master control signal from the master control module 140, and providing the drive signal to the second switch module 102 according to the first master control signal; and the high-voltage source 160 for providing the high-voltage signal. Specifically, the master control module 140 may be respectively coupled with the driver module 120 and the collection module 130, to control the driver module 120 to generate the drive signal and to receive the working state data from the collection module 130 in real time. The driver module 120 may be a digital-to-analog conversion driver module, and the digital-to-analog conversion driver module may be implemented by a dedicated digital-to-analog conversion chip, or by a micro-control unit with a digital-to-analog conversion function. The collection module 130 may be an analog-to-digital conversion collection module, and the analog-to-digital conversion collection module may be implemented by a dedicated analog-to-digital conversion chip, or by a micro-control unit with an analog-to-digital conversion function.

As shown in FIG. 8, the time-division multiplexing control device may further include the isolator 150 for isolating the master control module 140 from the central processing unit (CPU) module 100, so that the time-division multiplexing control device may operate in a high-voltage (kilovolt level) operation environment. The isolator 150 may be implemented by using a photocoupler, a pulse transformer, a relay, or an isolation circuit composed of the photocoupler, the pulse transformer, or the relay.

Figure 9:
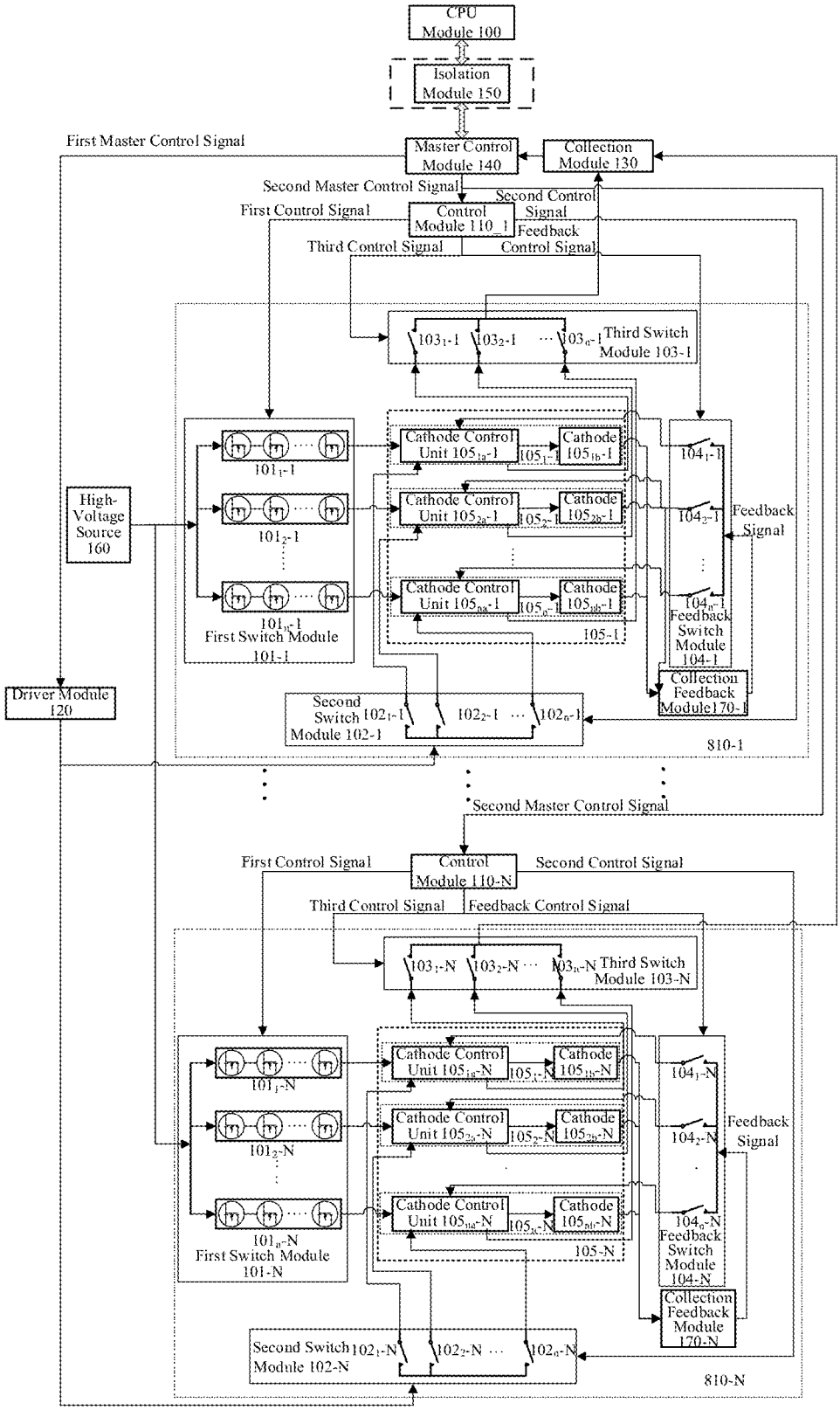
FIG. 9 shows a schematic diagram of a time-division multiplexing control system applied to a distributed X-ray source according to some embodiments of the present disclosure.

FIG. 9 shows a schematic diagram of a time-division multiplexing control system applied to a distributed X-ray source according to some embodiments of the present disclosure. The time-division multiplexing control system may include: a plurality of time-division multiplexing control devices 810 (as shown in FIG. 8); the collection module 130 for receiving the working state data from one of the plurality of time-division multiplexing control devices, and sending the working state data; the master control module 140 for providing the first master control signal, providing the second master control signal to the one of the plurality of time-division multiplexing control devices 810, and receiving the working state data from the collection module 130; the driver module 120 for receiving the first master control signal from the master control module 140, and providing the drive signal to the one of the plurality of time-division multiplexing control devices according to the first master control signal; and the high-voltage source for providing the high-voltage signal. The driver module 120 may be a digital-to-analog conversion driver module, and the digital-to-analog conversion driver module may be implemented by a dedicated digital-to-analog conversion chip, or by a micro-control unit with a digital-to-analog conversion function. The collection module 130 may be an analog-to-digital conversion collection module, and the analog-to-digital conversion collection module may be implemented by a dedicated analog-to-digital conversion chip, or by a micro-control unit with an analog-to-digital conversion function. The first switch, the second switch, the third switch and the feedback switch in the time-division multiplexing control device 810 may be implemented by analog switching elements, digital switching elements, relays or photocouplers.

A control module in the one of the plurality of time-division multiplexing control devices 810 (i.e., the time-division multiplexing control device 810-1 . . . the time-division multiplexing control device 810-N) may provide the first control signal, the second control signal, the third control signal and the feedback control signal, under the control of the second master control signal provided by the master control module 140.

The time-division multiplexing control system may further include: the isolator 150 for isolating the master control module 140 from the central processing unit (CPU) module 100, so that the time-division multiplexing control system may operate in a high-voltage (kilovolt level) operation environment. The isolator 150 may be implemented by using a photocoupler, a pulse transformer, a relay, or an isolation circuit composed of the photocoupler, the pulse transformer, or the relay.

As shown in FIG. 9, the isolation module 150 may be coupled with the master control module 140, the master control module 140 may be coupled with the control module 110-1 . . . the control module 110-N, and at the same time, the master control module 140 may be coupled with the driver module 120 and the collection module 130. The driver module 120 may be coupled with the second switch module 102-1 . . . the second switch module 102-N, the collection module 130 may be coupled with the third switch module 103-1 . . . the third switch module 103-N, and the high-voltage source 160 may be coupled with the first switch module 101-1 . . . the first switch module 101-N.

In the time-division multiplexing control device 810-1, the first switch module 101-1 may be coupled with a cathode control unit $\mathbf{105}_{1a}$-1, a cathode control unit $\mathbf{105}_{2}$-1 . . . a cathode control unit $\mathbf{105}_{na}$-1, and the first switch module 101-1 may be coupled with the control module 110-1 at the same time; the second switch module 102-1 may be coupled with the cathode control unit $\mathbf{105}_{1a}$-1, the cathode control unit $\mathbf{105}_{2a}$-1 . . . the cathode control unit $\mathbf{105}_{na}$-1, and the second switch module 102-1 may be coupled with the control module 110-1 at the same time; the third switch module 103-1 may be coupled with the cathode control unit $\mathbf{105}_{1a}$-1, the cathode control unit $\mathbf{105}_{2a}$-1 . . . the cathode control unit $\mathbf{105}_{na}$-1, and the third switch module 103-1 may be coupled with the control module 110-1 at the same time; the feedback switch module 104-1 may be coupled with the cathode control unit $\mathbf{105}_{1a}$-1, the cathode control unit $\mathbf{105}_{2a}$-1 . . . the cathode control unit $\mathbf{105}_{na}$-1, and the feedback switch module 104-1 may be coupled with the collection feedback module 170-1 and the control module 110-1; and the collection feedback module 170-1 may further be coupled with the cathode $\mathbf{105}_{1b}$-1, cathode $\mathbf{105}_{2b}$-1 . . . cathode $\mathbf{105}_{nb}$-1.

Similarly, in the time-division multiplexing control device 810-N, the first switch module 101-N may be coupled with a cathode control unit $\mathbf{105}_{1a}$-N, a cathode control unit $\mathbf{105}_{2a}$-N . . . a cathode control unit $\mathbf{105}_{na}$-N, and the first switch module 101-N may be coupled with the control module 110-N at the same time; the second switch module 102-N may be coupled with the cathode control unit $\mathbf{105}_{1a}$-N, the cathode control unit $\mathbf{105}_{2a}$-N . . . the cathode control unit $\mathbf{105}_{na}$-N, and the second switch module 102-N may be coupled with the control module 110-N at the same time; the third switch module 103-N may be coupled with the cathode control unit $\mathbf{105}_{1a}$-N, the cathode control unit $\mathbf{105}_{2a}$-N . . . the cathode control unit $\mathbf{105}_{na}$-N, and the third switch module 103-N may be coupled with the control module 110-N at the same time; the feedback switch module 104-N may be coupled with the cathode control unit $\mathbf{105}_{1a}$-N, the cathode control unit $\mathbf{105}_{2a}$-N . . . the cathode control unit $\mathbf{105}_{2a}$-N, and the feedback switch module 104-N may be coupled with the collection feedback module 170-N and the control module 110-N at the same time; and the collection and feedback module 170-N may further be coupled with the cathode $\mathbf{105}_{1b}$-N, cathode $\mathbf{105}_{2b}$-N . . . cathode $\mathbf{105}_{nb}$-N.

Other time-division multiplexing control devices not shown in FIG. 9 may have a similar structure to the time-division multiplexing control device 810-1 and the time-division multiplexing control device 810-N, and thus may not be repeated here.

The master control module 140 may control the operation of the time-division multiplexing control device 810-1 . . . the time-division multiplexing control device 810-N through the control module 110-1, the control module 110-2 . . . the control module 110-N, respectively, where only one control module may be controlled at the same moment. The operation of the time-division multiplexing control system will be described below by taking the master control module 140 controlling the time-division multiplexing control device 810-1 as an example.

The high-voltage source 160 may output the high-voltage signal to the first switch module 101-1. The master control module 140 may control the driver module 120 to output the drive signal, and the drive signal may be output to the second switch module 102-1. The master control module 140 may control the control module 110-1 to provide the first control signal, the second control signal, the third control signal and the feedback control signal. The control module 110-1 may output the first control signal to the first switch module 101-1 to turn on one switch in the first switch module 101-1. It should be noted that at the same moment, the first control signal may only turn on one first switch in the first switch module 101-1 and the high-voltage signal is transmitted through the first switch turned on, whereas the other first switches are all turn off at this moment and thus the high-voltage signal may not be transmitted through the other first switches. For example, when the first switch $\mathbf{101}_{2}$-1 is turned on, the high-voltage signal may be transmitted to the cathode control stage $\mathbf{105}_{2}$-1 through the first switch $\mathbf{101}_{2}$-1. The control module 110-1 may output the second control signal to the second switch module 102-1, to turn on a corresponding second switch in the second switch module 102-1. The control module 110-1 may output the third control signal to the third switch module 103-1, to turn on a corresponding third switch in the third switch module 103-1. The control module 110-1 may output the feedback control signal to the feedback switch module 104-1 to turn on a corresponding feedback switch in the feedback switch module 104-1. It should be noted that the first control signal is provided to turn on the first switch $\mathbf{101}_{2}$-1, so that the second control signal, the third control signal and the feedback control signal are provided to turn on the second switch $\mathbf{102}_{2}$-1, the third switch $\mathbf{103}_{2}$-1 and the feedback switch $\mathbf{104}_{2}$-1, which may enable the first switch turned on, the second switch turned on, the third switch turned on and the feedback switch turned on to couple with the same cathode control stage $\mathbf{105}_{2}$-1. The cathode control unit $\mathbf{105}_{2}$-1 in the cathode control stage $\mathbf{105}_{2}$-1 sends the drive control signal to the cathode $105_{2b}$-1 according to the received drive signal and high-voltage signal, the cathode $105_{2b}$-1 sends the feedback signal to the collection feedback module 170-1 according to the received drive control signal, and the collection feedback module 170-1 sends the feedback signal to the cathode control unit $105_{2a}$-1 through the feedback switch $104_2$-1 turned on. The cathode control unit $105_{2a}$-1 performs the automatic feedback adjustment according to the received feedback signal, outputs the working state data, and transmits the working state data to the collection module 130 through the third switch $103_2$-1 turned on. The collection module 130 may transmit the working state data to the master control module 140.

In a case where the master control module selects another time-division multiplexing control device (e.g., the time-division multiplexing control device 810-N), the operation process of the time-division multiplexing control system may be similar to the above-mentioned process, and thus it may not be repeated here.

Figure 10:
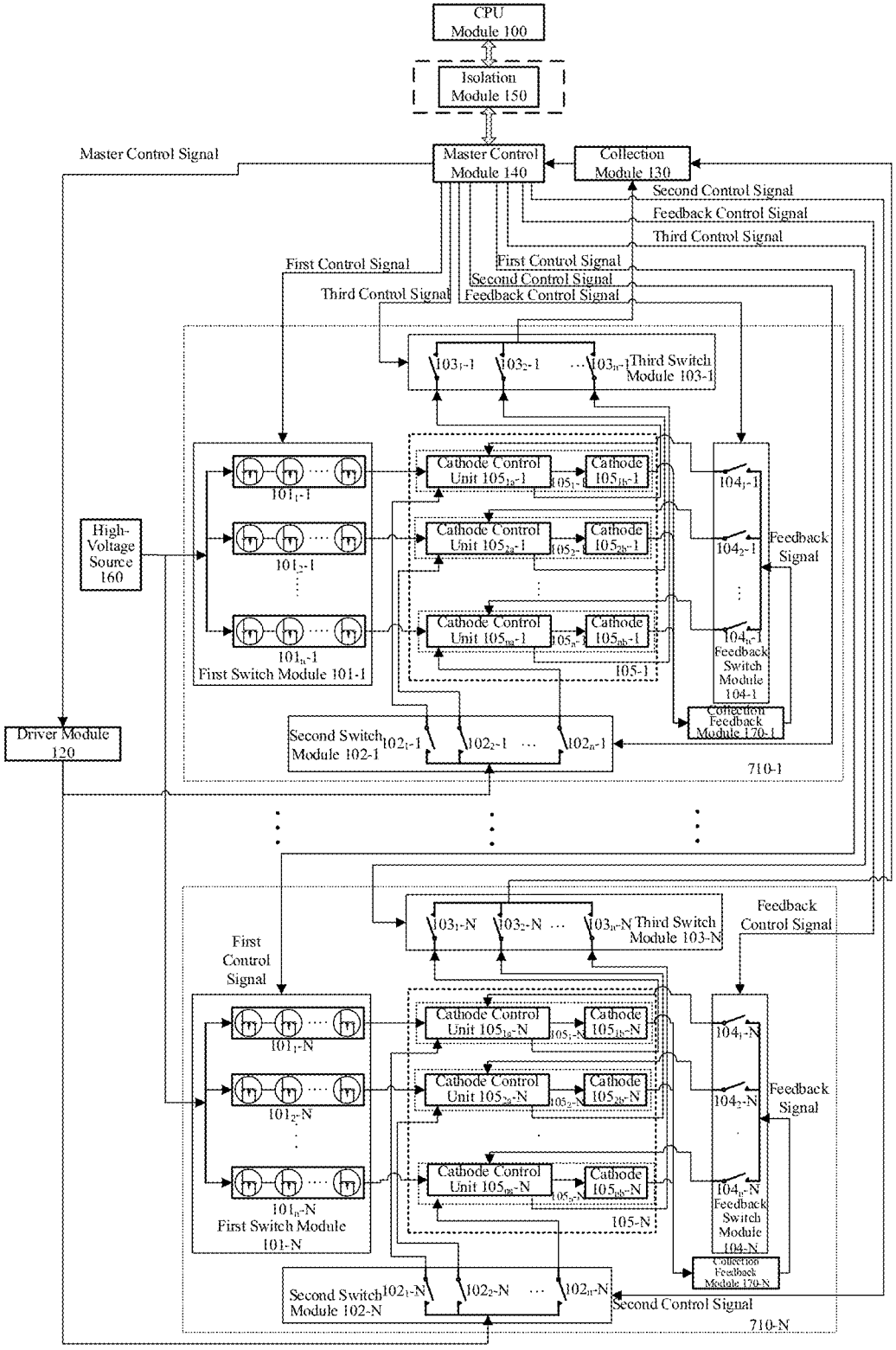
FIG. 10 shows a schematic diagram of another time-division multiplexing control system applied to a distributed X-ray source according to some embodiments of the present disclosure.

FIG. 10 shows a schematic diagram of another time-division multiplexing control system applied to a distributed X-ray source according to some embodiments of the present disclosure. The time-division multiplexing control system may include: a plurality of time-division multiplexing control devices 710 (as shown in FIG. 7); the collection module 130 for receiving the working state data from one of the plurality of time-division multiplexing control devices, and sending the working state data; the master control module 140 for providing the first control signal, the second control signal, the third control signal and the feedback control signal to the one of the plurality of time-division multiplexing control devices, providing the first master control signal, and receiving the working state data from the collection module 130; the driver module 120 for receiving the first master control signal from the master control module 140, and providing the drive signal to the one of the plurality of time-division multiplexing control devices according to the first master control signal; and the high-voltage source for providing the high-voltage signal. The driver module 120 may be a digital-to-analog conversion driver module, and the digital-to-analog conversion driver module may be implemented by a dedicated digital-to-analog conversion chip, or by a micro-control unit with a digital-to-analog conversion function. The collection module 130 may be an analog-to-digital conversion collection module, and the analog-to-digital conversion collection module may be implemented by a dedicated analog-to-digital conversion chip, or by a micro-control unit with an analog-to-digital conversion function. The first switch, the second switch, the third switch and the feedback switch in the time-division multiplexing control device 710 may be implemented by analog switching elements, digital switching elements, relays or photocouplers.

The time-division multiplexing control system may further include: the isolator 150 for isolating the master control module 140 from the central processing unit (CPU) module 100, so that the time-division multiplexing control system may operate in a high-voltage (kilovolt level) operation environment. The isolator 150 may be implemented by using a photocoupler, a pulse transformer, a relay, or an isolation circuit composed of the photocoupler, the pulse transformer, or the relay.

As shown in FIG. 10, the isolation module 150 may be coupled with the master control module 140, the master control module 140 may be coupled with the first switch module 101-1 . . . the first switch module 101-N, the second switch module 102-1 . . . the second switch module 102-N, the third switch module 103-1 . . . and the third switch module 103-N, and the feedback switch module 104-1 . . . and the feedback switch module 104-N; and at the same time, the master control module 140 may be coupled with the driver module 120 and the collection module 130. The driver module 120 may be coupled with the second switch module 102-1 . . . the second switch module 102-N, the collection module 130 may be coupled with the third switch module 103-1 . . . the third switch module 103-N, and the high-voltage source 160 may be coupled with the first switch module 101-1 . . . the first switch module 101-N.

In the time-division multiplexing control device 710-1, the first switch module 101-1 may be coupled with the cathode control unit $105_{1a}$-1, the cathode control unit $105_{2a}$-1, the cathode control unit 105*a*-1; the second switch module 102-1 may be coupled with the cathode control unit $105_{1a}$-1, the cathode control unit $105_2$-1 . . . the cathode control unit $105_{na}$-1; the third switch module 103-1 may be coupled with the cathode control unit $105_{1a}$-1, the cathode control unit $105_{2a}$-1 . . . the cathode control unit $105_{na}$-1; and the feedback switch module 104-1 may be coupled with the cathode control unit $105_{1a}$-1, the cathode control unit $105_{2a}$-1 . . . the cathode control unit $105_{na}$-1, and the feedback switch module 104-1 may be coupled with the collection feedback module 170-1 at the same time; and the collection feedback module 170-1 may further be coupled with the cathode $105_{1b}$-1, cathode $105_{2b}$-1 . . . cathode $105_{nb}$-1.

Similarly, in the time-division multiplexing control device 710-N, the first switch module 101-N may be coupled with a cathode control unit $105_{1a}$-N, a cathode control unit $105_{2a}$-N . . . a cathode control unit $105_{na}$-N; the second switch module 102-N may be coupled with the cathode control unit $105_{1a}$-N, the cathode control unit $105_{2a}$-N . . . the cathode control unit $105_{na}$-N; the third switch module 103-N may be coupled with the cathode control unit $105_{1a}$-N, the cathode control unit $105_{2a}$-N . . . the cathode control unit $105_{na}$-N; the feedback switch module 104-N may be coupled with the cathode control unit $105_{1a}$-N, the cathode control unit $105_{2a}$-N . . . the cathode control unit $105_{na}$-N, and the feedback switch module 104-N may be coupled with the collection feedback module 170-N at the same time; and the collection and feedback module 170-N may further be coupled with the cathode $105_{1b}$-N, cathode $105_{2b}$-N . . . cathode $105_{nb}$-N.

Other time-division multiplexing control devices not shown in FIG. 10 may have a similar structure to the time-division multiplexing control device 710-1 and the time-division multiplexing control device 710-N, and thus may not be repeated here.

The master control module 140 may control the operation of the time-division multiplexing control device 710-1 . . . the time-division multiplexing control device 710-N, respectively, where only one control module may be controlled at the same moment. The operation of the time-division multiplexing control system will be described below by taking the master control module 140 controlling the time-division multiplexing control device 710-1 as an example.

The high-voltage source 160 may output the high-voltage signal to the first switch module 101-1. The master control module 140 may control the driver module 120 to output the drive signal, and the drive signal may be output to the second switch module 102-1. The master control module 140 may output the first control signal to the first switch module 101-1 to turn on one switch in the first switch module 101-1. It should be noted that at the same moment, the first control signal may only turn on one first switch in the first switch module 101-1 and the high-voltage signal is transmitted through the first switch turned on, whereas the other first switches are all turn off at this moment and thus the high-voltage signal may not be transmitted through the other first switches. For example, when the first switch $\mathbf{101_2}$-1 is turned on, the high-voltage signal may be transmitted to the cathode control stage $\mathbf{105_2}$-1 through the first switch $\mathbf{101_2}$-1. The master control module 140 may output the second control signal to the second switch module 102-1, to turn on a corresponding second switch in the second switch module 102-1. The master control module 140 may output the third control signal to the third switch module 103-1, to turn on a corresponding third switch in the third switch module 103-1. The master control module 140 may output the feedback control signal to the feedback switch module 104-1 to turn on a corresponding feedback switch in the feedback switch module 104-1. It should be noted that the first control signal is provided to turn on the first switch $\mathbf{101_2}$-1, so that the second control signal, the third control signal and the feedback control signal are provided to turn on the second switch $\mathbf{102_2}$-1, the third switch $\mathbf{103_2}$-1 and the feedback switch $\mathbf{104_2}$-1, which may enable the first switch turned on, the second switch turned on, the third switch turned on and the feedback switch turned on to couple with the same cathode control stage $\mathbf{105_2}$-1. The cathode control unit $\mathbf{105_{2a}}$-1 in the cathode control stage $\mathbf{105_2}$-1 sends the drive control signal to the cathode $\mathbf{105_{2b}}$-1 according to the received drive signal and high-voltage signal, the cathode $\mathbf{105_{2b}}$-1 sends the feedback signal to the collection feedback module 170-1 according to the received drive control signal, and the collection feedback module 170-1 sends the feedback signal to the cathode control unit $\mathbf{105_{2a}}$-1 through the feedback switch $\mathbf{104_2}$-1 turned on. The cathode control unit $\mathbf{105_{2a}}$-1 performs the automatic feedback adjustment according to the received feedback signal, outputs the working state data, and transmits the working state data to the collection module 130 through the third switch $\mathbf{103_2}$-1 turned on. The collection module 130 may transmit the working state data to the master control module 140.

In a case where the master control module selects another time-division multiplexing control device (e.g., the time-division multiplexing control device 710-N), the operation process of the time-division multiplexing control system may be similar to the above-mentioned process, and thus it may not be repeated here.

The multi-focus X-ray source system provides an ability to simultaneously generate X-rays from a plurality of locations, however, in a large number of applications of multi-focus X-ray sources, usually only one cathode-anode assembly is in operation at the same moment. The time-division multiplexing control device and system according to the present disclosure adopt the time-division multiplexing principle, and applies a common control driver circuit and a common data collection circuit to a plurality of control channels, where the control system may switch to different channels at different moments to realize instantaneous switching of the working state of each cathode and to accurately control the working state data of each cathode, so that the multi-focus X-ray source may have the characteristics of fast start-up/shutdown, state switching, flexible parameter setting, etc., and the cost of multi-channel control system may be reduced.

Figure 11:
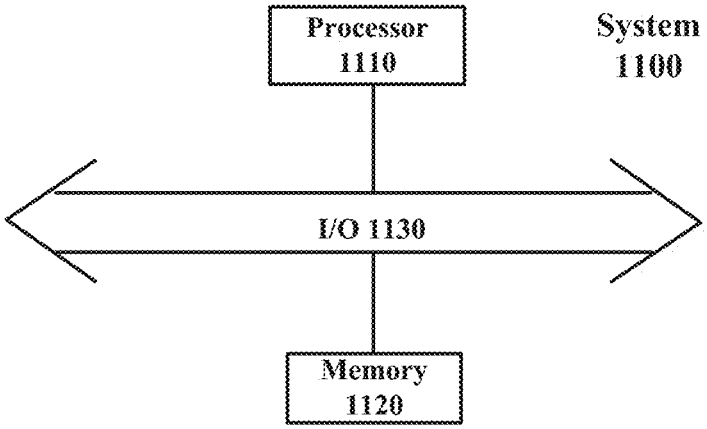
FIG. 11 shows a schematic diagram of a time-division multiplexing control system applied to a distributed X-ray source according to some embodiments of the present disclosure.

FIG. 11 shows a schematic diagram of a time-division multiplexing control system 1100 according to some embodiments of the present disclosure. The system 1100 may include a processor 1110, for example, a digital signal processor (DSP). The processor 1110 may be a single device or multiple devices for performing different actions of the processes described herein. The system 1100 may further include an input/output (I/O) device 1130 for receiving signals from other entities or sending signals to other entities.

In addition, the system 1100 may include a memory 1120, which may have the following forms: non-volatile or volatile memory, for example, an electrically erasable programmable read-only memory (EEPROM), a flash memory, etc. The memory 1120 may store computer-readable instructions, and when the processor 1110 executes the computer-readable instructions, the computer-readable instructions may cause the processor to perform the actions described herein.

Some block diagrams and/or flowcharts are shown in the drawings. It should be understood that some blocks in the block diagrams and/or flowcharts, or combinations thereof may be implemented by computer program instructions. These computer program instructions may be provided to a processor of a general-purpose computer, a special-purpose computer, or other programmable data processing device, so that when these instructions are executed by the processor, they may create a device for realizing the functions/operations described in these block diagrams and/or flowcharts.

Therefore, the technology of the present disclosure may be implemented in the form of hardware and/or software (including firmware, microcode, etc.). In addition, the technology of the present disclosure may take the form of a computer program product on a computer-readable medium storing instructions, the computer program product may be used by an instruction execution system (e.g., one or more processors) or used in conjunction with an instruction execution system. In the context of the present disclosure, a computer-readable medium may be any medium that may contain, store, transmit, propagate, or transmit instructions. For example, a computer-readable medium may include, but is not limited to, an electric, magnetic, optical, electromagnetic, infrared, or semiconductor system, device, device, or propagation medium. Specific examples of computer-readable media include: a magnetic storage device, such as a magnetic tape or a hard disk (HDD); an optical storage device, such as an optical disk (CD-ROM); a memory, such as a random access memory or flash memory; and/or a wired/wireless communication link.

The above detailed description has explained many embodiments of the time-division multiplexing control device and system by using schematic diagrams, flowcharts, and/or examples. In a case where such schematic diagrams, flowcharts and/or examples include one or more functions and/or operations, those skilled in the art should understand that each function and/or operation in such schematic diagrams, flowcharts or examples may be implemented individually and/or jointly through various structures, hardware, software, firmware, or any substantial combination thereof. In an embodiment, several parts of the subject matter described in the embodiments of the present disclosure may be implemented by an application specific integrated circuit (ASIC), a field programmable gate array (FPGA), a digital signal processor (DSP), or other integrated formats. However, those skilled in the art should understand that some aspects of the embodiments disclosed herein may be equivalently implemented in an integrated circuit in whole or in part, implemented as one or more computer programs running on one or more computers (e.g., implemented as one or more programs running on one or more computer systems), implemented as one or more programs running on one or more processors (e.g., implemented as one or more programs running on one or more microprocessors), implemented as a firmware, or essentially implemented as any combination of the above methods, and according to the present disclosure, those skilled in the art will have the ability to design circuits and/or write software and/or firmware codes. In addition, those skilled in the art will understand that the mechanism of the subject matter of the present disclosure may be distributed as various forms of program products, and the exemplary embodiments of the subject matter described in the present disclosure are applicable, regardless of the specific type of signal bearing medium actually used to perform the distribution. Examples of the signal bearing media include but are not limited to: recordable media, such as a floppy disk, a hard driver, a compact disk (CD), a digital versatile disk (DVD), a digital tape and a computer storage; and transmission media, such as digital and/or analog communication media (e.g., a fiber optic cable, a waveguide, a wired communication link, a wireless communication link, etc.).

What is claimed is:

1. A time-division multiplexing control device applied to a distributed X-ray source, comprising:

a first switch module comprising a plurality of first switches, used for receiving a high-voltage signal and a first control signal, selectively turning on one of the plurality of first switches according to the first control signal and sending the high-voltage signal through the first switch turned on; and a cathode control module comprising a plurality of cathode control stages in one-to-one correspondence with the plurality of first switches, each cathode control stage comprising a cathode control unit and a cathode, wherein in a cathode control stage corresponding to the first switch turned on, a cathode control unit receives the high-voltage signal from the first switch module, and sends a drive control signal to a corresponding cathode.

2. The time-division multiplexing control device according to claim 1, wherein the cathode control unit is configured to acquire a feedback signal from the cathode, perform automatic feedback adjustment on the drive control signal according to the feedback signal, and send working state data; and the cathode is configured to receive the drive control signal from the cathode control unit, and send the feedback signal to the cathode control unit.

3. The time-division multiplexing control device according to claim 2, wherein each of the plurality of first switches is formed by a plurality of metal oxide semiconductor MOS transistors in series.

4. The time-division multiplexing control device according to claim 2, further comprising:

a second switch module comprising a plurality of second switches in one-to-one correspondence with the plurality of cathode control stages, used for receiving a drive signal and a second control signal, selectively turning on one of the plurality of second switches according to the second control signal, and sending the drive signal through the second switch turned on, wherein the cathode control module is further configured to receive the drive signal from the second switch module, and send the working state data through one of the plurality of cathode control stages corresponding to the first switch turned on and the second switch turned on, and wherein the first control signal and the second control signal are provided so that the first switch turned on and the second switch turned on are coupled with the same cathode control stage.

5. The time-division multiplexing control device according to claim 4, further comprising:

a third switch module comprising a plurality of third switches in one-to-one correspondence with the plurality of cathode control stages, used for receiving a third control signal, receiving the working state data from the cathode control module, selectively turning on one of the plurality of third switches according to the third control signal, and sending the working state data through the third switch turned on, wherein the first control signal, the second control signal, and the third control signal are provided so that the first switch turned on, the second switch turned on, and the third switch turned on are coupled with the same cathode control stage.

6. The time-division multiplexing control device according to claim 5, further comprising:

a control module for providing the first control signal to the first switch module, the second control signal to the second switch module, and the third control signal to the third switch module under control of a second master control signal.

7. The time-division multiplexing control device according to claim 6, further comprising:

a collection module for receiving the working state data from the third switch module and sending the working state data;

a master control module for providing a first master control signal, providing the second master control signal to the control module, and receiving the working state data from the collection module;

a driver module for receiving the first master control signal from the master control module, and providing the drive signal to the second switch module according to the first master control signal;

a high-voltage source for providing the high-voltage signal; and an isolator for isolating the master control module from a central processing unit module, wherein the time-division multiplexing control device operates in a high-voltage operation environment, and the first switch, the second switch, and the third switch are implemented by using analog switch elements, digital switch elements, relays, or photocouplers.

8. The time-division multiplexing control device according to claim 7, wherein the driver module is a digital-to-analog conversion driver module and the collection module is an analog-to-digital conversion collection module.

9. A time-division multiplexing control system applied to a distributed X-ray source, comprising:

a plurality of time-division multiplexing control devices according to claim 6;

a collection module for receiving the working state data from one of the plurality of time-division multiplexing control devices, and sending the working state data;

a master control module for providing a first master control signal, providing the second master control signal to the one of the plurality of time-division multiplexing control devices, and receiving the working state data from the collection module;

a driver module for receiving the first master control signal from the master control module, and providing the drive signal to the one of the plurality of time-division multiplexing control devices according to the first master control signal; and a high-voltage source for providing the high-voltage signal.

10. The time-division multiplexing control system according to claim 9, wherein, a control module of the one of the plurality of time-division multiplexing control devices provides the first control signal, the second control signal and the third control signal under control of the second master control signal provided by the master control module.

11. A time-division multiplexing control system applied to distributed X-ray sources, including:

a plurality of time-division multiplexing control devices according to claim 5;

a collection module for receiving the working state data from one of the plurality of time-division multiplexing control devices, and sending the working state data;

a master control module for providing the first control signal, the second control signal and the third control signal to the one of the plurality of time-division multiplexing control devices, providing a first master control signal, and receiving the working state data from the collection module;

a driver module for receiving the first master control signal from the master control module, and providing the drive signal to the one of the plurality of time-division multiplexing control devices according to the first master control signal; and a high-voltage source for providing the high-voltage signal.

12. The time-division multiplexing control device according to claim 1, further comprising:

a collection feedback module configured to receive a feedback signal from the cathode control module and send the feedback signal; and a feedback switch module comprising a plurality of feedback switches, used for receiving a feedback control signal, receiving the feedback signal from the collection feedback module, selectively turning on one of the plurality of feedback switches according to the feedback control signal, and sending the feedback signal to the cathode control module through the feedback switch turned on, wherein in the cathode control stage corresponding to the first switch turned on, the cathode control unit is configured to receive the high-voltage signal and the feedback signal, send the drive control signal to the cathode, perform automatic feedback adjustment according to the feedback signal, and send working state data; the cathode is configured to send the feedback signal to the collection feedback module according to the drive control signal.

13. The time-division multiplexing control device according to claim 12, wherein each of the plurality of first switches is formed by a plurality of metal oxide semiconductor MOS transistors in series.

14. The time-division multiplexing control device according to claim 12, further comprising:

a second switch module comprising a plurality of second switches in one-to-one correspondence with the plurality of cathode control stages, used for receiving a drive signal and a second control signal, selectively turning on one of the plurality of second switches according to the second control signal, and sending the drive signal through the second switch turned on, wherein the cathode control module is further configured to receive the drive signal from the second switch module, and send the working state data through one of the plurality of cathode control stages corresponding to the first switch turned on and the second switch turned on, and wherein the first control signal and the second control signal are provided so that the first switch turned on and the second switch turned on are coupled with the same cathode control stage.

15. The time-division multiplexing control device according to claim 14, further comprising:

a third switch module comprising a plurality of third switches in one-to-one correspondence with the plurality of cathode control stages, used for receiving a third control signal, receiving the working state data from the cathode control module, selectively turning on one of the plurality of third switches according to the third control signal, and sending the working state data through the third switch turned on, wherein the first control signal, the second control signal, the third control signal and a feedback control signal are provided so that the first switch turned on, the second switch turned on, the third switch turned on and a feedback switch turned on are coupled with the same cathode control stage.

16. The time-division multiplexing control device according to claim 15, further comprising:

a control module for providing the first control signal to the first switch module, the second control signal to the second switch module, the third control signal to the third switch module and the feedback control signal to a feedback switch module under control of a second master control signal.

17. The time-division multiplexing control device according to claim 16, further comprising:

a collection module for receiving the working state data from the third switch module and sending the working state data;

a master control module for providing a first master control signal, providing the second master control signal to the control module, and receiving the working state data from the collection module;

a driver module for receiving the first master control signal from the master control module, and providing the drive signal to the second switch module according to the first master control signal;

a high-voltage source for providing the high-voltage signal; and an isolator for isolating the master control module from a central processing unit module, wherein the time-division multiplexing control device operates in a high-voltage operation environment, and the first switch, the second switch, the third switch, and the feedback switch are implemented by using analog switch elements, digital switch elements, relays, or photocouplers.

18. A time-division multiplexing control system applied to a distributed X-ray source, comprising:

a plurality of time-division multiplexing control devices according to claim 16;

a collection module for receiving the working state data from one of the plurality of time-division multiplexing control devices, and sending the working state data;

a master control module for providing a first master control signal, providing the second master control signal to the one of the plurality of time-division multiplexing control devices, and receiving the working state data from the collection module;

a driver module for receiving the first master control signal from the master control module, and providing the drive signal to the one of the plurality of time-division multiplexing control devices according to the first master control signal; and a high-voltage source for providing the high-voltage signal.

19. The time-division multiplexing control system according to claim 18, wherein, a control module of the one of the plurality of time-division multiplexing control devices provides the first control signal, the second control signal, the third control signal and the feedback control signal, under control of the second master control signal provided by the master control module.

20. A time-division multiplexing control system applied to distributed X-ray sources, including:

a plurality of time-division multiplexing control devices according to claim 18;

a collection module for receiving the working state data from one of the plurality of time-division multiplexing control devices, and sending the working state data;

a master control module for providing the first control signal, the second control signal, the third control signal and the feedback control signal, providing a first master control signal, and receiving the working state data from the collection module;

a driver module for receiving the first master control signal from the master control module, and providing the drive signal to the one of the plurality of time-division multiplexing control devices according to the first master control signal; and a high-voltage source for providing the high-voltage signal.

* * * * *